US012156619B2

(12) United States Patent
Burns

(10) Patent No.: US 12,156,619 B2
(45) Date of Patent: Dec. 3, 2024

(54) ROBOTIC CLEANING DEVICES, ASSOCIATED SYSTEMS, AND METHODS OF USING THE SAME

(71) Applicant: Shirley Burns, Savannah, GA (US)

(72) Inventor: Shirley Burns, Savannah, GA (US)

( * ) Notice: Subject to any disclaimer, the term of this patent is extended or adjusted under 35 U.S.C. 154(b) by 0 days.

(21) Appl. No.: 18/775,283

(22) Filed: Jul. 17, 2024

(65) Prior Publication Data

US 2024/0366052 A1 Nov. 7, 2024

Related U.S. Application Data

(63) Continuation-in-part of application No. 18/183,586, filed on Mar. 14, 2023.

(60) Provisional application No. 63/344,185, filed on May 20, 2022.

(51) Int. Cl.

| | |
|---|---|
| ***A47L 11/164*** | (2006.01) |
| ***A47L 11/16*** | (2006.01) |
| ***A47L 11/40*** | (2006.01) |

(52) U.S. Cl.

CPC ..... *A47L 11/164* (2013.01); *A47L 11/161* (2013.01); *A47L 11/4069* (2013.01); *A47L 2201/04* (2013.01)

(58) Field of Classification Search

CPC .... A47L 9/0483; A47L 9/0472; A47L 11/307; A47L 11/305; A47L 11/302; A47L 11/2025; A47L 2201/04; A47L 13/48; A47L 11/4066; A47L 11/4036; A47L 11/4008; A47L 11/12; A47L 11/4011

USPC ..... 15/319

See application file for complete search history.

(56) References Cited

U.S. PATENT DOCUMENTS

| | | | |
|---|---|---|---|
| 2018/0199785 | A1 | 7/2018 | Farmer |
| 2022/0066456 | A1 | 3/2022 | Ebrahimi Afrouzi et al. |

FOREIGN PATENT DOCUMENTS

| | | | |
|---|---|---|---|
| CN | 215738714 | U | 2/2022 |
| EP | 0424229 | A1 | 4/1991 |
| JP | 5787428 | B1 | 9/2015 |
| JP | 2017-131355 | A | 8/2017 |
| KR | 10-0596479 | B1 | 7/2006 |
| KR | 10-2015-0042070 | | 4/2015 |

OTHER PUBLICATIONS

International Search Report and Written Opinion for PCT/US2023/066439 (ISA/KR) mailed Aug. 22, 2023 (11 pages).

*Primary Examiner* — Tom Rodgers

(74) *Attorney, Agent, or Firm* — Alston & Bird LLP

(57) ABSTRACT

A robotic cleaning device, along with associated systems and methods of using the same, is described. The device may include a body portion that may define a top surface, a bottom surface, and a continuous sidewall surface. An example device may further include a drive system that propels the robotic device. An example device may further include two or more bottom brushes. An example device may further include a continuous opening that extends around the sidewall surface. An example device may further include a pair of sidewall brushes that may oscillate along the opening.

20 Claims, 19 Drawing Sheets

ROBOTIC CLEANING DEVICES, ASSOCIATED SYSTEMS, AND METHODS OF USING THE SAME

CROSS-REFERENCE TO RELATED APPLICATIONS

This application is a continuation-in-part of U.S. Non-provisional application Ser. No. 18/183,586, filed on Mar. 14, 2023, which claims priority to U.S. Provisional Application No. 63/344,185 filed on May 20, 2022, the contents of each of which are hereby incorporated by reference in their entirety.

BACKGROUND

Related Field

The present disclosure relates to a robotic device capable of engaging with a cleaning environment (e.g., bathtub, shower, etc.) to allow for easier cleaning of the bottom surface and at least one sidewall.

Related Art

Robotic device may be used to clean a surface in various situations. Exemplary known cleaning robotic systems may include a cleaning device configured to engage one or more surfaces. Generally, though, these known robotic devices focus one engaging the one or more surfaces via features located on only one surface (e.g., a bottom surface) thereof. Such conventional systems thus do not provide a manner for cleaning one or more differently oriented surfaces in a simultaneous manner, let alone doing so with feature positioned on a single surface. Thus, a need exists for improved robotic devices providing enhanced coverage and performance.

BRIEF SUMMARY

Various embodiments of the present disclosure describe and comprise robotic devices, cleaning apparatuses, mobile devices, and corresponding systems, devices, components, and methods related to robotic devices.

For example, in certain embodiments, a robotic device for cleaning a surrounding environment is provided. In these embodiments, the robotic device may include a body portion that may define at least a top surface, a bottom surface, and/or a continuous sidewall surface. In these and/or other embodiments, the sidewall surface may be defined by a perimeter of the body portion. In these and/or other embodiments, the robotic device may further comprise a drive system that includes at least two drive elements configured to propel the robotic device within the surrounding environment. In these and/or other embodiments, the at least two drive elements may extend a distance beneath the bottom surface. In these and/or other embodiments, the robotic device may further comprise two or more bottom brushes having a primary axis of each brush that extends below the bottom surface and extends at least partially beyond the at least two drive elements to engage the surrounding environment. In these and/or other embodiments, the robotic device may further comprise a continuous opening that extends around the sidewall surface. In these and/or other embodiments, the robotic device may further comprise a pair of sidewall brushes that extend from the robotic device. In these and/or other embodiments, the pair of sidewall brushes sidewall brushes may be configured to oscillate along the continuous opening until making contact with each other.

In various embodiments, the robotic device may further comprise a storage compartment. In certain embodiments, the storage compartment may store the pair of sidewall brushes and may be defined between the top surface and the bottom surface at an end of the robotic device. In some embodiments, the pair of sidewall brushes may move from a stored position to an active position, relative to the storage compartment, upon an activation of a cycle. In some embodiments, the pair of sidewall brushes may be positioned in a vertical manner relative to the storage compartment while in the active position.

In various embodiments, the pair of sidewall brushes may oscillate horizontally relative to the continuous opening of the robotic device. In some embodiments, the pair of sidewall brushes may oscillate individually from each other from a first linear position to a second linear position along the continuous opening. In some embodiments, a first sidewall brush may oscillate along a first side of the robotic device, and a second sidewall brush may oscillate along a second side of the robotic device, wherein the first side and the second side are relative to the sidewall surface. In some embodiments, the first linear position may be defined by the storage compartment at a first end of the robotic device. In some embodiments, the second linear position may be defined by the linearly opposite end of the robotic device relative to the storage compartment.

In various embodiments, the robotic device may further comprise a bumper. In certain embodiments, the bumper may extend around the body portion to protect a finish of the surrounding environment.

In various embodiments, the robotic device may further comprise a controller and at least one sensor. In certain embodiments, the controller and the at least one sensor may be configured to detect a location of the robotic device within the surrounding environment and communicate the location to guide the robotic device. In some embodiments, the controller may further comprise a processor. In at least one embodiments, the processor may be configured to communicate with the controller to direct the robotic device. In these and/or other embodiments, the controller, directed by the processor, may control at least one oscillating function of the pair of sidewall brushes. In some embodiments, the controller may further comprise a communication element that communicates with at least one electronic device.

In various embodiments, the robotic device may further comprise at least one power switch. In certain embodiments, the at least one power switch activates the robotic device and/or selects a cycle type.

For example, in certain embodiments, a robotic system for cleaning a surrounding environment is provided. In these embodiments, the robotic system may include a robotic device. In some embodiments, the robotic device may include a body portion that may define at least a top surface, a bottom surface, and/or a continuous sidewall surface. In these and/or other embodiments, the sidewall surface may be defined by a perimeter of the body portion. In these and/or other embodiments, the robotic device may further comprise a drive system that includes at least two drive elements configured to propel the robotic device within the surrounding environment. In these and/or other embodiments, the at least two drive elements may extend a distance beneath the bottom surface. In these and/or other embodiments, the robotic device may further comprise two or more bottom brushes having a primary axis of each brush that extends below the bottom surface and extends at least partially beyond the at least two drive elements to engage the surrounding environment. In these and/or other embodiments, the robotic device may further comprise a continuous opening that extends around the sidewall surface. In these and/or other embodiments, the robotic device may further comprise a pair of sidewall brushes that extend from the robotic device. In these and/or other embodiments, the pair of sidewall brushes sidewall brushes may be configured to oscillate along the continuous opening until making contact with each other. In these and/or other embodiments, the robotic system may further comprise a distributed network that may communicate with one or more electronic devices and with the robotic system.

For example, in certain embodiments, a method of operating a robotic device is provided. In these embodiments, the method may include selective, via a power switch, a power type and/or a cycle type. In these and/or other embodiments, the method may further comprise causing an activation of a cycle for the robotic device to begin cleaning a surrounding environment. In these and/or other embodiments, the robotic device may comprise a body portion that may define at least a top surface, a bottom surface, and/or a continuous sidewall surface. In these and/or other embodiments, the sidewall surface may be defined by a perimeter of the body portion. In these and/or other embodiments, the robotic device may further comprise a drive system that includes at least two drive elements configured to propel the robotic device within the surrounding environment. In these and/or other embodiments, the at least two drive elements may extend a distance beneath the bottom surface. In these and/or other embodiments, the robotic device may further comprise two or more bottom brushes having a primary axis of each brush that extends below the bottom surface and extends at least partially beyond the at least two drive elements to engage the surrounding environment. In these and/or other embodiments, the robotic device may further comprise a continuous opening that extends around the sidewall surface. In these and/or other embodiments, the robotic device may further comprise a pair of sidewall brushes that extend from the robotic device. In these and/or other embodiments, the pair of sidewall brushes sidewall brushes may be configured to oscillate along the continuous opening until making contact with each other. In these and/or other embodiments, the robotic device may further comprise at least one power switch that may activate the robotic device and/or select a cycle type.

In various embodiments, the cycle type may define the running time of the robotic device and the cleaning type. In some embodiments, the depressing of the at least one power switches a predetermined number of time selects at least one cycles. In some embodiments, the selecting of different cycles and/or run times may be based on the number of depressions of the power switch.

In various aspects, a robotic device for cleaning a surrounding environment comprises a body portion that defines at least a top surface, a bottom surface, and a continuous sidewall surface. The sidewall surface may be defined by a perimeter of the body portion. The robotic device may comprise a drive system that includes at least two drive elements configured to propel the robotic device within the surrounding environment. The at least two drive elements may extend a distance beneath the bottom surface. The robotic device may comprise two or more bottom brushes having a primary axis of each brush that extends below the bottom surface and extend at least partially beyond the at least two drive elements to engage the surrounding environment. The robotic device may comprise a continuous opening that extends around the sidewall surface, wherein the continuous opening is defined along the sidewall surface between the top surface and the bottom surface. The continuous opening may extend purely horizontally around an entirety of the perimeter of the body portion. The robotic device may comprise at least one sidewall brush that extends from the body portion and is configured to travel along the continuous opening and relative to the top surface and the bottom surface of the body portion. Each of the at least one sidewall brush may be configured to travel along the continuous opening with the assistance of a sidewall drive mechanism that comprises a connection rod.

In various examples, the at least one sidewall brush is positioned in a vertical manner.

In various examples, the at least one sidewall brush is configured to travel horizontally relative to the continuous opening of the robotic device.

In various examples, a first sidewall brush of the at least one sidewall brush is configured to travel along a first side of the robotic device, and a second sidewall brush of the at least one sidewall brush is configured to travel along a second side of the robotic device, wherein the first side and the second side are relative to the sidewall surface.

In various examples, the robotic device comprises a bumper that extends around the body portion, wherein the bumper protects a finish of the surrounding environment.

In various examples, the robotic device comprises a controller and at least one sensor to detect a location of the robotic device in the surrounding environment and communicate the location to guide the robotic device.

In various examples, the controller further comprises a processor configured to communicate with the controller of the robotic device.

In various examples, the controller, directed by the processor, controls at least one traveling function of the at least one sidewall brush.

In various examples, the continuous opening extends circumferentially around the sidewall surface and the at least one sidewall brush is configured to travel circumferentially along the continuous opening.

In various examples, the at least one sidewall brush is positioned in a vertical manner, and wherein the at least one sidewall brush is configured to remain in the vertical position as it travels along the continuous opening.

In various examples, the at least one sidewall brush extends vertically 18 inches tall.

In various examples, the at least one sidewall brush extends vertically at least 6 inches and up to 18 inches tall.

In various examples, each of the at least one sidewall brush comprises a plurality of bristles that are configured to contact a sidewall surface of a tub or shower when the robotic device is cleaning the surrounding environment.

In various examples, the plurality of bristles are configured to receive a cleaning solution from a reservoir to deliver the cleaning solution to the sidewall surface of the tub or shower.

In various examples, the robotic device is for cleaning a bottom surface and at least one sidewall of a bathtub or a shower.

In various examples, the at least one sidewall brush is configured to move from a first position to a second position, wherein the first position is at a back of the robotic device and the second position is at a front of the robotic device.

In various examples, the first position is at least ninety degrees from the second position relative to a center of the robotic device.

In various examples, the continuous opening extends circumferentially around the sidewall surface and the at least one sidewall brush is configured to travel circumferentially along the continuous opening.

In various examples, the at least one sidewall brush is configured to move from a first position to a second position, wherein the first position is at a back of the robotic device and the second position is at a front of the robotic device.

In various examples, each of the at least one sidewall brush is positioned in a vertical manner, and wherein each of the at least one sidewall brush is configured to remain in the vertical position as it travels along the continuous opening from the first position to the second position.

In various examples, each of the at least one sidewall brush extends vertically at least 6 inches and up to 18 inches tall.

In various examples, the robotic device comprises comprising a vertical center shaft and a large gear. Each of the at least one sidewall brush may be coupled to a respective connection rod of a respective sidewall drive mechanism. Each connection rod may be configured to pivot around the vertical center shaft. Each sidewall drive mechanism may further comprises a motor and a small gear that is coupled to the motor and is configured to be rotatable by the motor. The small gear may be positioned such that gear teeth of the small gear mesh with gear teeth of the large gear. Each sidewall drive mechanism may be configured to orbit a respective sidewall brush around the body portion of the robotic device when its small gear is rotated by its motor.

In various examples, each sidewall drive mechanism further comprises a second motor that is coupled to a distal end of the respective connection rod, wherein the second motor is configured to rotate the respective sidewall brush on an axis that extends through the sidewall brush.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses may potential embodiments in addition to those here summarized, some of which will be further described below. Other features, aspects, and advantages of the subject matter will become apparent from the description, the drawings, and the claims.

BRIEF DESCRIPTION OF THE DRAWINGS

The following drawings are illustrations of a particular embodiment of the present disclosure and therefore do not limit the scope of the present disclosure. The drawings are not necessarily drawn to scale and are intended for use in conjunction with explanation in the following description.

DETAILED DESCRIPTION

Figure 1A:
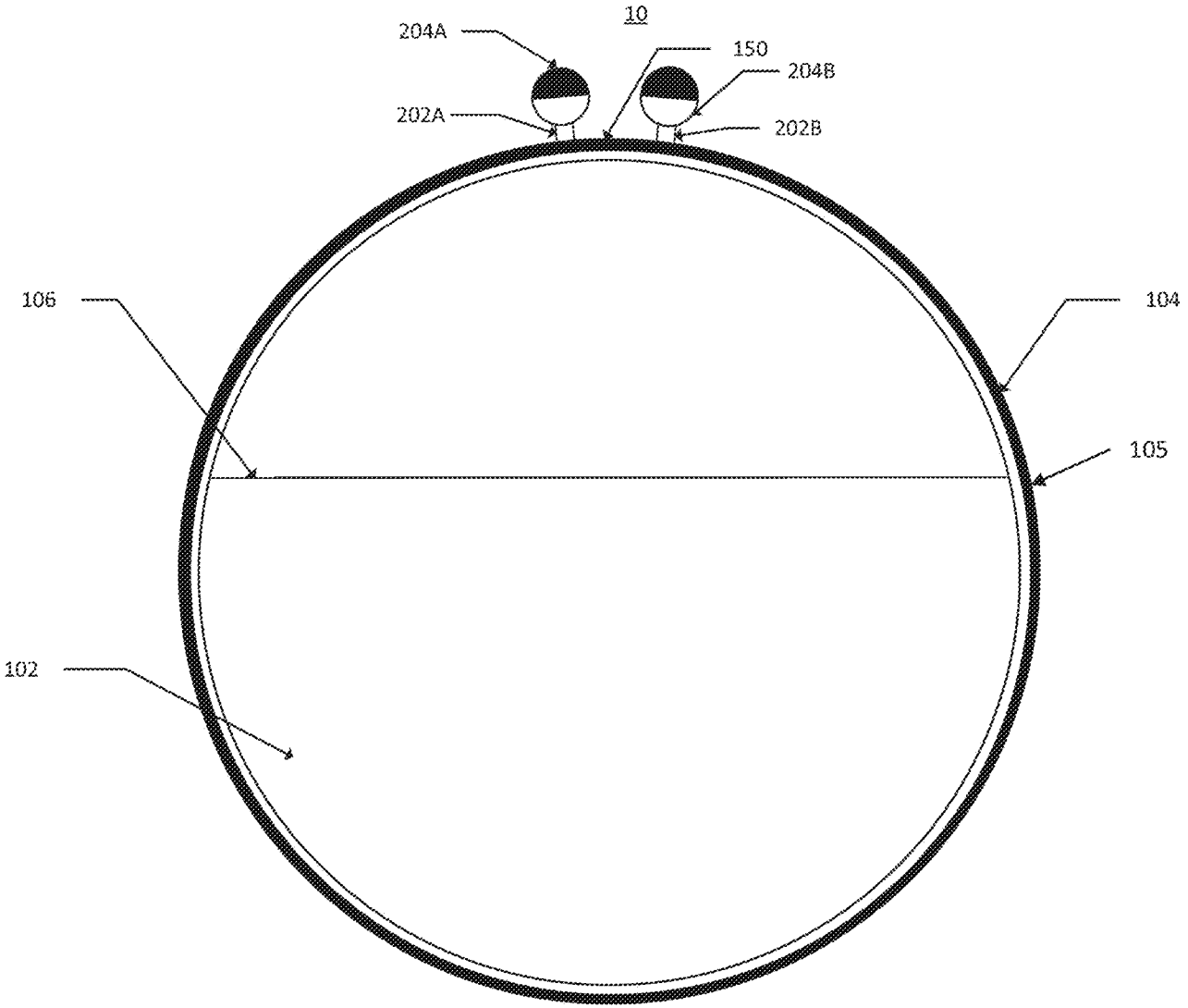
FIG. 1A illustrates an exemplary top view of a robotic device in accordance with various embodiments of the present disclosure.

Various embodiments of the present invention will be described in a more detailed manner hereinafter with reference to the accompanying drawings, in which some, embodiments of the invention are shown. Reference numbers refer to like elements throughout the drawings. Multiple embodiments of the current invention may be embodied in different forms and should not be limited to the embodiments set forth herein. Rather, these embodiments are provided so that this disclosure will satisfy applicable legal requirements.

As used herein, terms such as "front," "rear," "top," etc. are used for explanatory purposes in the examples provided below to describe the relative positions of certain components or portions of components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of specific values listed. Thus, use of any such aforementioned terms, or similarly interchangeable terms, should not be taken to limit the spirit and scope of embodiments of the present invention. As used in the specification and the appended claims, the singular form of "a," "an," and "the" include plural references unless otherwise stated. The terms "includes" and/or "including," when used in the specification, specify the presence of stated feature, elements, and/or components; it does not preclude the presence or addition of one or more other features, steps, operations, elements, components, and/or groups thereof.

As used herein, the phrases "in one embodiment," "according to one embodiment," "in some embodiments," and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment. As used herein, the terms "example," "exemplary," and the like are used to "serving as an example, instance, or illustration." Any implementation, aspect, or design described herein as "example" or "exemplary" is not necessarily to be construed as preferred or advantageous over other implementations, aspects, or designs. Rather, use of the terms "example," "exemplary," and the like are intended to present concepts in a concrete fashion.

As used herein, the term "battery-powered" is intended to refer to devices capable of engaging a battery to receive electrical power (e.g., wall outlet, or the like) in at least some circumstances. The term "battery-powered" is intended to be interpreted inclusively and includes devices capable of engaging a battery as well as devices capable of being plugged in to a non-battery power source in at least some circumstances.

Aspects of the present disclosure may be implemented as computer program products that comprises articles of manufacture. Such computer program products may include one or more software components including, for example, applications, software objects, methods, data structure, and/or the like. A software component may be coded in any of a variety of programming languages. An illustrative programming language may be a lower-level programming language such as an assembly language associated with a particular hardware architecture and/or operating system platform/system.

Other example of programming languages included, but are not limited to, a macro language, a shell or command language, a job control language, a script language, a database query, or search language, and/or report writing language. In one or more example embodiments, a software component comprising of instructions in one of the foregoing examples of programming languages may be executed directly by an operating system or other software component without having to be first transformed into another form. A software component may be stored as a file or other data storage methods. Software components of a similar type or functionally related may be stored together such as, for example, in a particular directory, folder, or library. Software components may be static (e.g., pre-established, or fixed) or dynamic (e.g., created or modified at the time of execution).

Additionally, or alternatively, aspects of the present disclosure may be implemented as a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media may include all computer-readable media (including volatile and non-volatile media).

In one aspect, a non-volatile readable storage may include a floppy disk, flexible disk, hard disk, solid-state storage (SSS) (e.g., a solid-state drive (SSD), solid state card (SSC), solid state module (SSM), enterprise flash drive, magnetic tape, and/or the like. A non-volatile computer-readable storage medium may also include compact disc read only memory (CD-ROM), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, SmartMedia cards, CompactFlash (CF) cards, Memory Sticks, and/or the like. Further, a non-volatile computer-readable storage medium may also include conductive-bridging random access memory (CBRAM), phase-change random access memory (PRAM), ferroelectric random-access memory (Fe-RAM), non-volatile random-access memory (NVRAM), magnetoresistive random-access memory (MRAM), resistive random-access memory (RRAM), Silicon-Oxide-Nitride-Oxide-Silicon memory (SONOS), floating junction gate random access memory (FJG RAM), Millipede memory, racetrack memory, and/or the like.

In one aspect, a volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, register memory, and/or the like. It will be appreciated that where aspects are described to use a computer-readable storage medium, other types of computer-readable storage media may be substituted for or used in addition to the computer-readable storage media described above.

Aspects of the present disclosure are described below with reference to block diagrams and flowchart illustrations. Thus, it should be understood that each block of the block diagrams and flowchart illustrations may be implemented in the form of a computer program product, a solely hardware aspect, a combination of hardware and computer program products, and/or apparatus, systems, computing devices, computing entities, and/or the like carrying out instructions, operations, steps, and similar words used interchangeably (e.g., the executable instructions, instructions for execution, program code, and/or the like) on a computer-readable storage medium for execution. For example, retrieval, loading, and execution of code may be performed sequentially such that one instruction is retrieved, loaded, and executed at a time. In some embodiments, retrieval, loading, and/or execution may be performed in parallel such that multiple instructions are retrieved, loaded, and/or executed together. Thus, such aspects can produce specifically configured machines performing the steps or operations specified in the block diagrams and flowchart illustrations. Accordingly, the block diagrams and flowchart illustrations support various combinations of aspects for performing the specified instructions, operations, or steps.

As should be appreciated, various aspects of the present disclosure may also be implemented as methods, apparatuses, systems, computing devices, computing entities, and/or the like. As such, aspects of the present disclosure may take the form of a data structure, apparatus, system, computing device, computing entity, and/or the like executing instructions stored on a computer-readable storage medium to perform certain steps or operations. Thus, aspects of the present disclosure may also take the form of an entirely hardware aspect, an entirely computer program product aspect, and/or an aspect that comprises combination of computer program products and hardware performing certain steps or operations.

The figures are provided to illustrate some examples of the invention described. The figures are not to limit the scope of the present embodiment of the invention or the appended claims. Aspects of the example embodiment are described below with reference to example applications for illustration. It should be understood that specific details, relationships, and methods are set forth to provide a full understanding of the example embodiment. One of ordinary skill in the art recognize the example embodiment can be practice without one or more specific details and/or with other methods.

The present disclosure relates to a robotic device capable of cleaning a bathtub and/or shower to allow for an ergonomic cleaning function for users who may be handicapped, lost use of upper body strength, elderly users, etc. Various devices and methods are also provided. In some example embodiments, the robotic device disclosed herein may be used to clean a plurality of surfaces of a bathtub and/or shower. In various embodiments, the robotic device may comprise a driving mechanism and a cleaning mechanism. The driving mechanism may be configured to move the robotic device throughout the cleaning environment (e.g., bathtub, shower, etc.). Typical robotic devices are configured to only clean a bottom surface within the cleaning environment. This requires users, in the case of the cleaning environment being a bathtub and/or shower, to still manually clean one or more additional surfaces manually. The present disclosure solves these problems and other via the robotic device disclosed herein.

In some instances, various robotic devices clean a plurality of surfaces simultaneously within a surrounding environment. The robotic device according to various embodiments of the present disclosure may be able to engage with and/or clean a plurality of cleaning surfaces simultaneously. For example, the robotic device may be configured to deploy one or more sidewall brushes upon the activation of a cleaning cycle. The one or more sidewall brushes may be configured to engage with at least one sidewall of the cleaning environment while one or more bottom brushes of the robotic device engages the bottom surface of the cleaning environment.

As described herein, the invention includes a robotic device that utilizes at least one sidewall brush and at least one bottom brush to allow for easy cleaning of a surrounding environment (e.g., bathtub, shower, bathroom, kitchen, etc.).

Figure 4:
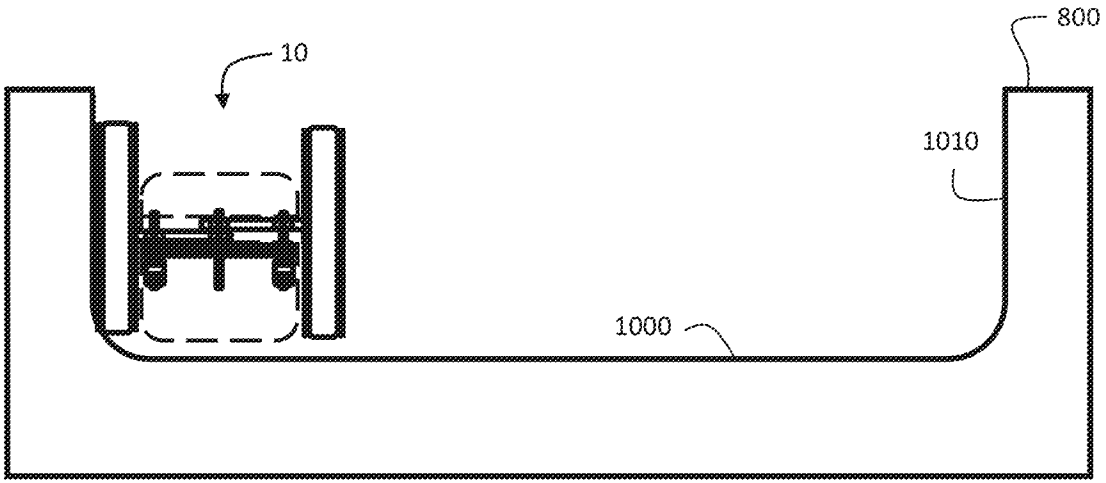
FIG. 4 illustrates a robotic device in a tub, in accordance with various embodiments of the present disclosure.

FIG. 1A illustrates a top view of an exemplary robotic device 10 in accordance with various embodiments of the present disclosure. In various embodiments, an exemplary robotic device 10 may comprise a body portion 102, a bumper 104, at least one connection rod 202A, 202B (collectively '202'), and/or at least one side wall brush 204A, 204B (collectively '204'). The body portion 102 may define at least a top surface, a bottom surface, and/or a continuous sidewall surface 105, wherein the continuous sidewall surface 105 is defined between the top surface and the bottom surface. In various embodiments, as illustrated in FIG. 1A, an exemplary robotic device 10 may be configured for cleaning a surrounding environment (e.g., a bath, a shower, etc.) with the assistance of two or more sidewall brushes 204 that are configured to engage one or more sidewalls 1010 (FIG. 4) of a bathtub 800 (FIG. 4) and/or shower. In various embodiments, a first sidewall brush 204A may be configured to secure to a first connection rod 202A and/or a second sidewall brush 204B may be configured to secure to a second connection rod 202B. The first sidewall brush 204A may be disposed linearly opposite of the second sidewall brush 204B, such that, the first sidewall brush 204A engages with a first sidewall of a tub and the second sidewall brush 204B engages with a second sidewall of a tub either simultaneously and/or individually. The first sidewall brush 204A and/or the second sidewall brush 204B may comprise a half-circle shape. In various embodiments, the sidewall brushes 204 may extend vertically up to 18 inches tall, such as at least 6 inches tall and up to 18 inches tall, such as at least 12 inches tall and up to 18 inches tall. In other embodiments, the first sidewall brush 204A and/or the second sidewall brush 204*b* may comprise any shape suitable to complete a cleaning operation (e.g., circular, triangular, square, rectangular, etc.).

In various embodiments, the sidewall brushes 204 may comprise a plurality of bristles 205 (FIG. 3F) that may contact the sidewall surfaces of the surrounding environment (e.g., tub and/or shower). In various embodiments, the plurality of bristles may be flexible and/or are configured to bend at least in part upon rotation. In other embodiments, the bristles of the sidewall brushes 204 may be rope like, such that, the bristles easily conform to the sidewall surface of the surrounding environment. In various embodiments, the plurality of bristles may be configured to receive cleaning solution and/or water from the corresponding reservoirs, wherein the plurality of bristles may be configured deliver the cleaning solution and/or water to the sidewalls of the bathtub and/or shower.

In various embodiment, the sidewall brushes 204 oscillate horizontally along an opening, described in detail herein after, with the assistance of rotating and/or oscillating mechanism 330. The sidewall brushes 204 may oscillate horizontally relative to the sidewall surface 105 of the robotic device 10. In various embodiments, the sidewall brushes 204 may rotate simultaneously while oscillating along the opening. In other embodiments, the sidewall brushes 204 may rotate while at a first linear position and/or at a second linear position.

With further reference to FIG. 1A, in various embodiments, the robotic device 10 may further comprise at least one door 106. The at least one door 106 may be configured to open and close via one or more hinges allowing a user to access the inside of the robotic device 10. In various embodiments, the at least one door 106 may allow a user to access a removable battery, a removable water reservoir, a removable cleaning solution reservoir, and/or the like. In various embodiments, the at least one door 106 may be configured to be the whole top surface of the robotic device 10, such that, the user may remove the whole top surface of the body portion 102. While in other embodiments, the door 106 may be configured to be just a portion of the top surface of the robotic device 10. In one or more example embodiments, the body portion 102 may further comprise a bumper 104 configured to prevent the robotic device 10 from scratching one or more surfaces of the cleaning environment. The bumper 104 may comprise a rubber like material, wherein the rubber like material may be clear, white, and/or the like.

FIGS. 1A-IC depict exemplary views of a robotic device 10 in accordance with various embodiments of the present disclosure. The robotic device 10 may comprise at least one sidewall brush 204 that may be configured to extend laterally from the body portion 102 of the robotic device 10. The one or more sidewall brushes 204, while in a deployed position, may be configured to oscillate horizontally along the sidewall surface of the robotic device 10 from a first position to a second position. In various embodiments, the one or more sidewall brushes 204 may be configured to move from the first position (e.g., back of the robotic device 102B) to the second position (e.g., front of the robotic device 102A). The one or more sidewall brushes 204 may be configured to oscillate along an opening 203 (depicted in FIGS. 1B-1C) located along the sidewall surface of the robotic device 10, wherein the oscillation function is described hereinafter in detail. The opening is defined along the sidewall surface 105 of the body portion 102, wherein the opening 203 is disposed vertically between the top surface and the bottom surface of the robotic device 10. The opening 203 may extend horizontally along the sidewall surface of the body portion 102 of the robotic device 10, such that, the opening 203 extends around at least half of the body portion 102. In other embodiment, the opening 203 may extend horizontally along the sidewall surface, such that, the opening extends the body portion 102 fully, such as extends completely around the body portion 102 circumferentially. In various embodiments, a first sidewall brush 204*a* may be configured to oscillate simultaneously with a second sidewall brush 204*b*. The first sidewall brush 204*a* and the second sidewall brush 204*b* may contact each other while in the first position and/or in the second position. In other embodiments, the first sidewall brush 204*a* may be configured to oscillate in an alternate configuration with the second sidewall brush 204*b*. For example, the first sidewall brush 204*a* may move clockwise while the second sidewall brush 204*b* moves counterclockwise, and vice-versa.

Figure 1B:
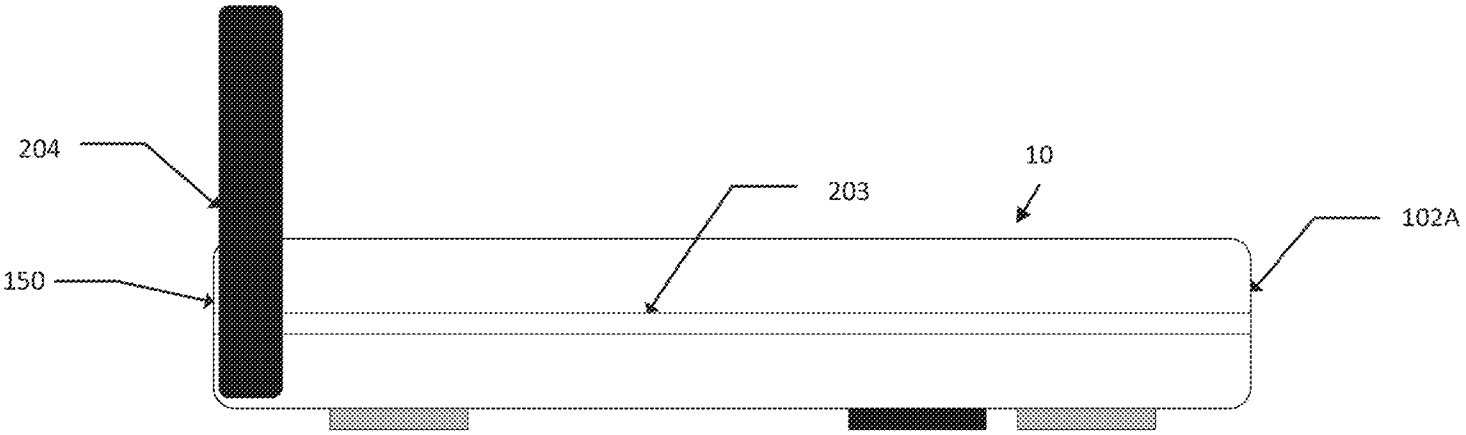
FIG. 1B illustrates an exemplary left side view of a robotic device with a brush in a first position in accordance with various embodiments of the present disclosure.
Figure 1C:
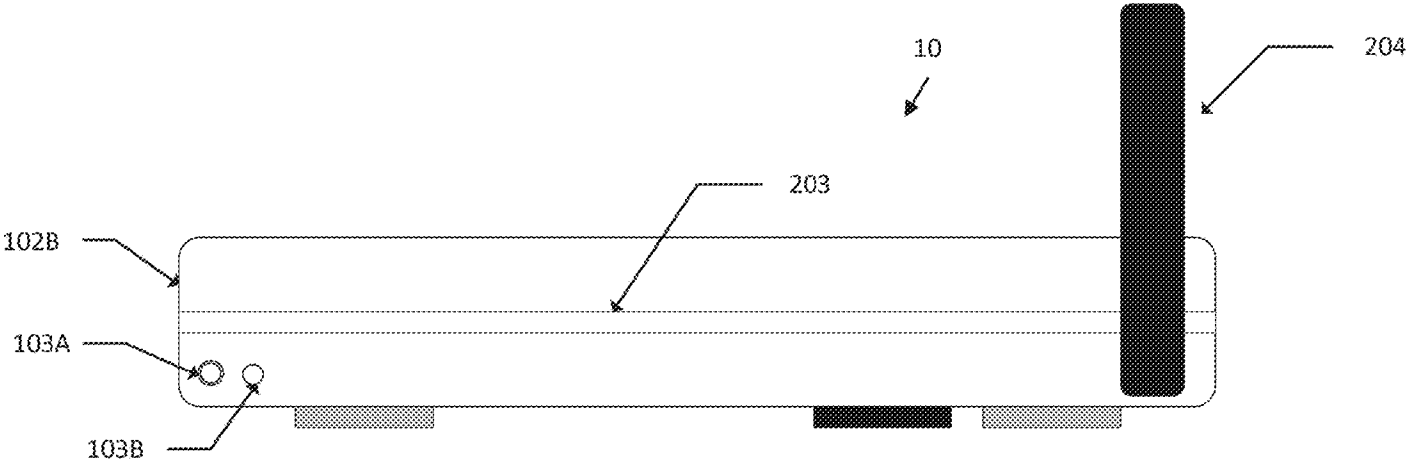
FIG. 1C illustrates an exemplary right side view of a robotic device with a brush in a second position in accordance with various embodiments of the present disclosure.

With further reference to FIGS. 1A-1C, in various embodiments, the robotic device 10 may be further comprise at least one battery charging plug-in 103A and/or at least one power switch 103B. The at least one battery charging plug-in 103A and the at least one power switch 103B may further comprise a waterproof seal preventing liquid from entering the port. In various embodiments, a user may be configured to charge the robotic device 10 by connecting the at least one battery charging plug-in to an electrical connection. In other embodiments, a user may begin a cleaning cycle of the robotic device 10 by depressing the power switch 103B a predetermined number of times. Different number of depressions of the power switch result in the selection of different cycles and/or run times. In various embodiments, the one or more sidewall brushes 204 may be configured to begin oscillating back and forth from the first position to the second position when a user activates a cycle. The cycle may be activated by a user engagement with the power switch 103B and/or may be activated via a user's wireless device. The first sidewall brush 204A and the second sidewall brush 204B may oscillate simultaneously (e.g., at the same rate), wherein both sidewall brushes 204 may start from the first position and end at the second position. In further embodiments, the first sidewall brush 204A and/or the second sidewall brush 204B may oscillate from the first position to the second position and repeat the pattern a plurality of times, wherein the plurality of times may be based on at least in part a timer, a cycle, a rotation rate, and/or the like.

With further reference to FIGS. 1A-1C, in various embodiments, the sidewall surface 105 may further comprise one or more storage compartments 150. The storage compartment may be defined by an opening along the continuous sidewall surface 105. The storage compartment 150 may be disposed at a first end of the robotic device 10 and further comprise at least one door. The door may open by any means necessary (e.g., hinges, springs, pistons, etc.) to allow the sidewall brushes 204 to be stored. The storage compartment 150 may be configured to store the one or more sidewall brushes 204. The storage compartment 150 may automatically open upon the activation of one or more cycles and/or close upon completion the cycle. In various embodiments, the storage compartment 150 may be configured to open upon the activation of one or more cleaning cycles, wherein the one or more sidewall brushes 204 are configured to extend vertically upon the activation of one or more cleaning cycles for the robotic device 10.

With still further reference to FIG. 1B-1C, the at least one side wall brush 204 may be configured to oscillate from a stored position to an active position upon the activation of one or more cleaning cycles. The first sidewall brush 204A and/or the second sidewall cleaning brush 204B may be stored within the robot device in a storage compartment 150 (e.g., depicted in FIG. 1A). The storage compartment 150 stores at least one side wall brush 204 when in the stored position. In other embodiments, the storage compartment 150 may store two or more sidewall brushes 204 when in the stored position. The sidewall brush 204 may comprise a flexible connection rod 202 that allows the sidewall brush 204 to easily move from the stored position to the active position. In various embodiments, the storage compartment 150 may comprise an opening function that is configured to allow the sidewall brushes 204 to move from the retracted position to the active position. In various embodiments, the sidewall brushes 204 may automatically oscillate from the stored position to the retracted position upon the activation of at least one cycle and/or activation of the robotic device 10. In other embodiments, the activation of the cycle and/or activation of the robotic device 10 may automatically extend the connection rods 202, such that, the user may secure the sidewall brushes 204 to the connection rods 202.

Figure 1D:
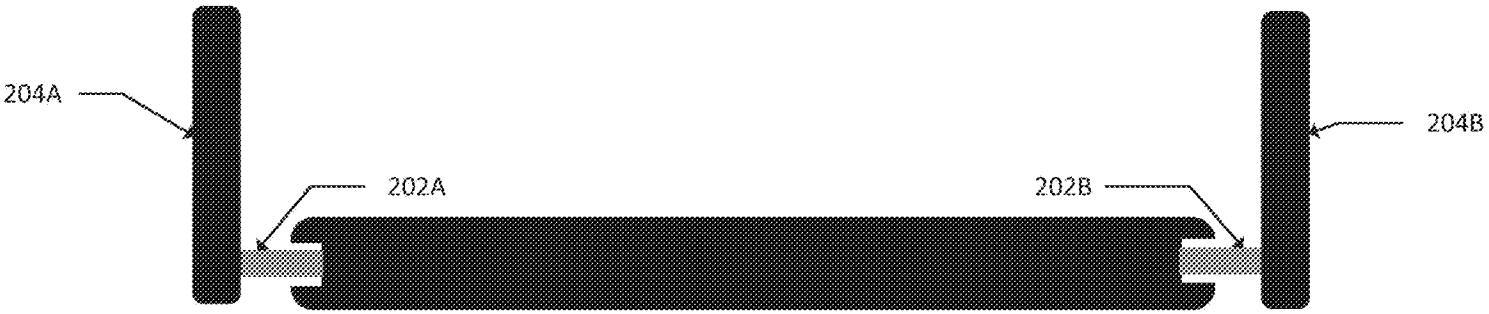
FIG. 1D illustrates an exemplary front view of a robotic device in accordance with various embodiments of the present disclosure.

FIG. 1D depicts an exemplary front view of a robotic device 10 in accordance with various embodiments of the present disclosure. In various embodiments, the first sidewall brush 204A may be secured to the robotic device 10 via the first connection rod 202A and/or the second sidewall brush 204B may be secured to the robotic device 10 via the second connection rod 202B. The connection rods 202 may extend laterally beyond the outermost edge of the robotic device 10. The connection rods 202 secures to the respective sidewall brush 204 via any need necessary (e.g., screws, bolts, nails, etc.). In other embodiments, the connection rod 202 are a protrusion of the sidewall brush 204, wherein the sidewall brush 204 and the connection rod 202 make an L shape or a sideways T shape. The connection between the sidewall brushes 204 and the connection rods 202 may allow the sidewall brushes 204 to rotate in a plurality of directions, wherein the sidewall brushes 204 may rotate horizontally to clean a surface and/or rotate vertically to move from the stored position to the active position. The connection rods 202 may assist with the oscillation of the sidewall brushes 204 along an opening of the robotic device 10, wherein the connection rods 202 move horizontally relative to the opening as described in detail hereinafter.

Figure 1E:
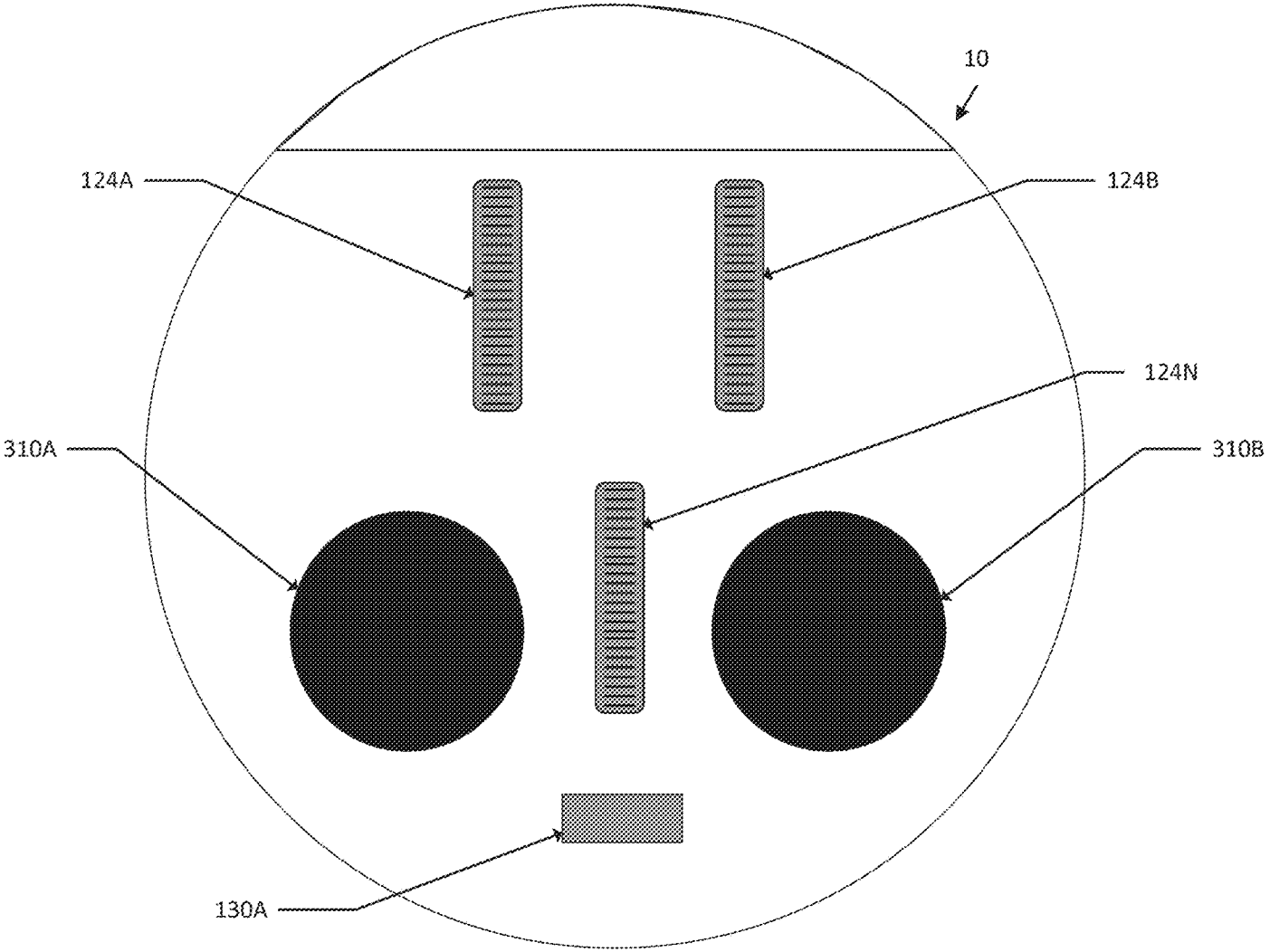
FIG. 1E illustrates an exemplary bottom view of a robotic device in accordance with various embodiments of the present disclosure.

FIG. 1E depicts an exemplary bottom view of a robotic device 10 in accordance with various embodiments of the present disclosure. In accordance with various embodiments, the bottom surface of the robotic device 10 may comprise one or more sensors 130A, one or more drive elements 124A, 124B, 124N, and/or one or more bottom brushes 310A, 310B (collectively '310'). In various embodiments, the robotic device 10 may comprise one or more bottom brushes 310 configured to clean the bottom surface 1000 of a bathtub and/or shower. In one of more example embodiments, the robotic device 10 may comprise two or more bottom brushes 310. The robotic device 10 may comprise a first bottom brush 310A disposed on a first half of the bottom surface of the robot and/or a second bottom brush 310B disposed a second half of the bottom surface of the robot. In various embodiments, the first bottom brush 310A and/or the second bottom brush 310B may be configured to oscillate in a clockwise direction and/or a counterclockwise direction. In other embodiments, the first bottom brush 310A and/or the second bottom brush 310B may be configured to complete full rotation either in the clockwise direction and/or the counterclockwise direction. In various embodiments, the first bottom brush 310A and/or the second bottom brush 310B may be configured to oscillate and/or rotate in opposite directions of each other simultaneously (e.g., first bottom brush 310A oscillates and/or rotate in the clockwise direction and/or second bottom brush oscillates and/or rotates in the counterclockwise direction). In other embodiments, the first bottom brush 310A and the second bottom brush 310B may be configured to oscillate and/or rotate in the same direction. In various embodiments, the one or more bottom brushes 310 may be configured to be removable from the robotic device 10 for cleaning of the brush and/or replacing the brush.

With further reference to FIG. 1E, the robotic device 10 may comprise two or more drive elements (e.g., wheels, tracks, belts etc.). In various embodiments, a first drive element 124A and a second drive element 124B may be disposed linearly opposite of each other. In some embodiments, the robotic device 10 may further comprise one or more additional drive element 124N configured to assist with the movement of the robotic device 10. The drive elements 124 may be driven by one or more motors and/or may be configured to rotate independently from each other, such that, the robotic device 10 is configured to turn within the cleaning environment (e.g., bathtub and/or shower). In various embodiments, the drive elements 124 may configure the robotic device 10 to move in a plurality of directions (e.g., forwards, backwards, right, left, etc.) simultaneously and/or individually. In one or more example embodiments, the robotic device 10 may comprise four or more drive elements 124, wherein at least two drive elements 124A on a first side and at least two drive elements 124B on a second side. In the depicted embodiments, the robotic device 10 may comprise two drive elements 124A, 124B disposed towards the rear of the of the system a an at least one drive element 124N disposed between the bottom brushes 310 and towards the front of the system.

Figure 2:
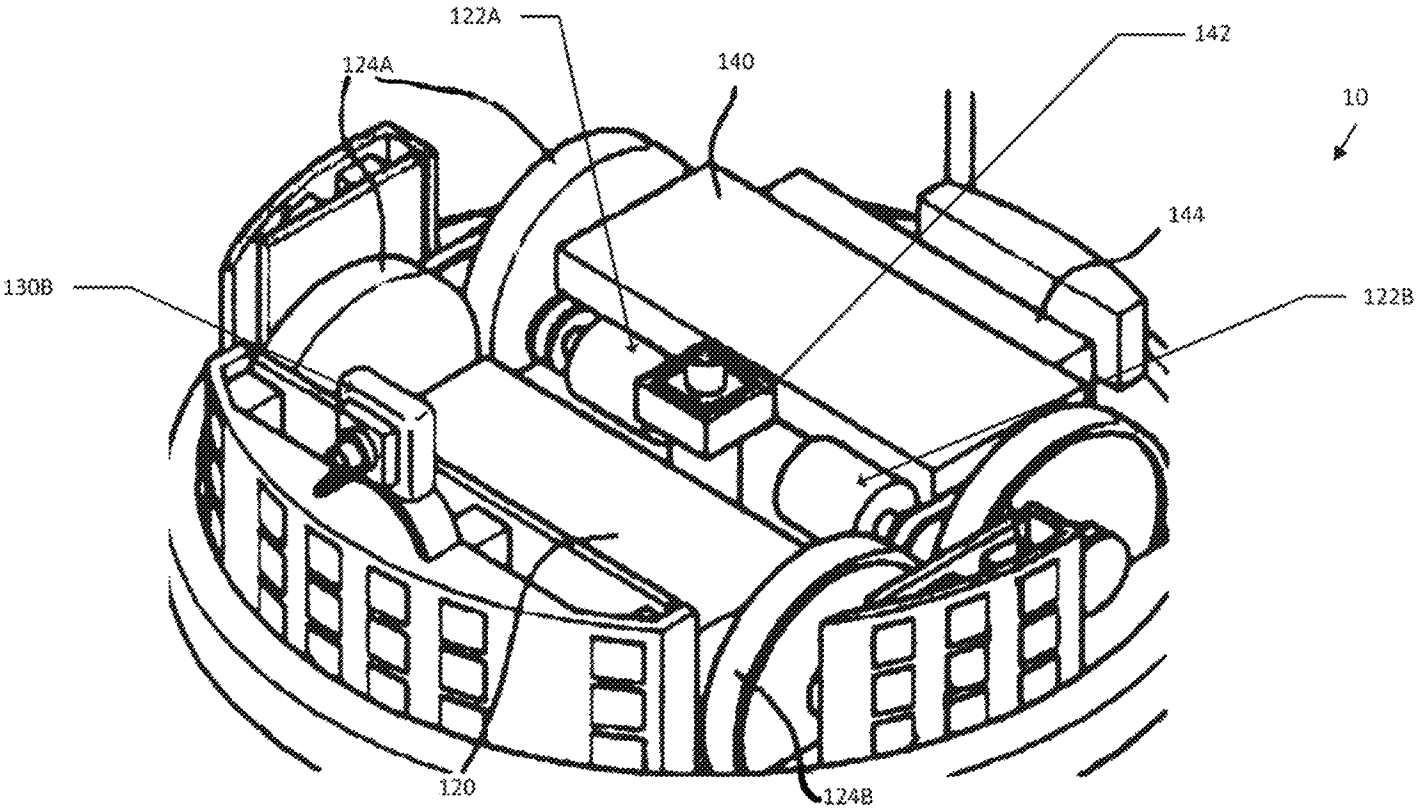
FIG. 2 illustrates an exemplary isometric view of a drive system in accordance with various embodiments of the present disclosure.

FIG. 2 depicts an exemplary bottom view of a robotic device 10 depicting a drive mechanism and cleaning mechanism in accordance with various embodiments of the present disclosure. In various embodiments, a drive mechanism may comprise at least one battery 120, at least one motor 122, and/or at least one drive element 124. In various embodiments, the drive elements 124 may be wheels, tacks, belts, and/or the like configured to engage with the bottom surface of the cleaning environment (e.g., bathtub and/or shower). In various embodiments, the drive mechanism may comprise at least one drive element 124A disposed on a first side and at least one drive element 124B disposed on a second side. In other embodiments, the drive mechanism may comprise two or more drive elements 124A on the first side and two or more drive elements 124B on the second side. The drive mechanism may comprise further at least one motor 122 configured to activate the one or more drive elements. The motors 122 may be electrically connected to the at least one battery 120, wherein the battery may be a rechargeable battery. The battery 120 may be configured to conduct electrical current to the motors 122 when a user activates a cleaning cycle. In various embodiments, the robotic device 10 may comprise a plurality of motors 122, wherein a first motor 122A may be configured to drive a first set of drive elements 124A and a second motor 122B may be configured to drive a second set of drive elements 124B. The first motor 122A and/or the second motor 122B may be configured to drive the corresponding drive elements 124A, 124B simultaneously and/or separately.

With further reference to FIG. 2, in various embodiments, a robotic device 10 may further comprise a cleaning mechanism configured to supply one or more brushes with cleaning solution and/or water. In various embodiments, the cleaning mechanism may comprise at least one water reservoir 140, at least one fill spout 142, and/or at least one cleaning solution reservoir 144. In various embodiments, the at least one water reservoir 140 may be connected to the at least one fill spout 142, wherein a user may be able refill the water reservoir 140 without removing the reservoir from the cleaning system by adding additional water to the fill spout 142. In other embodiments, the water reservoir 140 may be configured to be removable from the robotic device 10, wherein the user can fill the water reservoir via the fill spout 142 and/or directly. In various embodiments, the cleaning mechanism further comprises one or more additional fill spouts (e.g., not depicted). The one or more additional fill spouts may be configured to connect to the at least one cleaning solution reservoir 144. In various embodiments, both the water reservoir and/or cleaning solution reservoir may further comprise connection channels connected to one or more sidewall brushes 204 and/or one or more bottom brushes 310. The water reservoir 140 and/or the cleaning solution reservoir 144 may be configured to supply the one or more brushes with the appropriate amount of liquids based on a selected cleaning cycle. In various embodiments, the water reservoir 140 and/or the cleaning solution reservoir 144 may be configured to supply one or more brushes with the corresponding liquids simultaneously. In other embodiments, the water reservoir 140 and/or the cleaning solution reservoir 144 may be configured to supply one or more brushes with the corresponding liquids separately.

With even further reference to FIG. 2, in various embodiments, a robotic device 10 may further comprise one or more sensors. In various embodiments, the one or more sensors 130B may be a locational sensor, a vision sensor, a communication sensor, light detection and ranging sensor (Lidar) and/or the like. In various embodiments, the one or more sensors may be a locational sensors 130B, such that, the locational sensor may be configured to track the location of the robotic device 10 and/or the traveled path of the robotic device 10 within a cleaning environment. The one or more locational sensors may be a RFID tag, NFC tags, Bluetooth beacons, GPS receivers, Wi-Fi transceivers, and/or the like. The one or more locational sensors 130B may be active trackers (e.g., GPS receivers, Wi-Fi transceivers, accelerometer, etc.) capable of generating signals and/or data for transmitting and/or receiving data to/from a controller and/or user device. For example, the locational sensor 130B (e.g., depict in FIG. 1D) may include, but are not limited to, RFID tags, NFC tags, Bluetooth beacons, GPS receivers, Wi-Fi transceivers, and/or the like configured to emit a signal, whether passively (e.g., via radio interrogation, such as RFID) or actively (e.g., via active signal generation and transmission, such as Bluetooth), detectable by a computing device for determining the location of the robotic device 10. In various embodiments, the robotic device 10 may further comprise at least one vision sensor (e.g., not depicted). In various embodiments, one or more vision sensor may be a 2-D camera, a 3-D camera, and/or the like. The one or more vision sensor may be configured to determine the location of the robotic device 10 using vision data gathered.

Figure 3A:
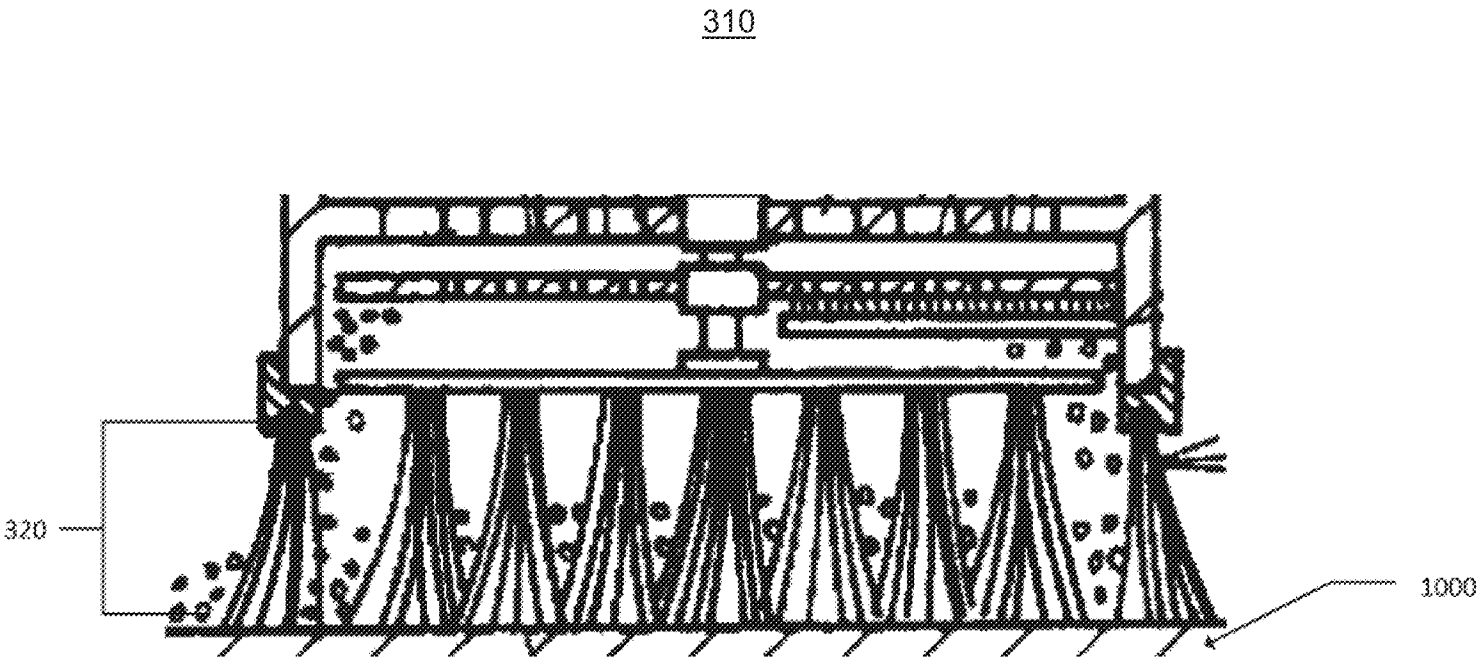
FIG. 3A illustrates an exemplary side view of a set of brushes engaging an exemplary cleaning surface in accordance with various embodiments of the present disclosure.
Figure 3B:
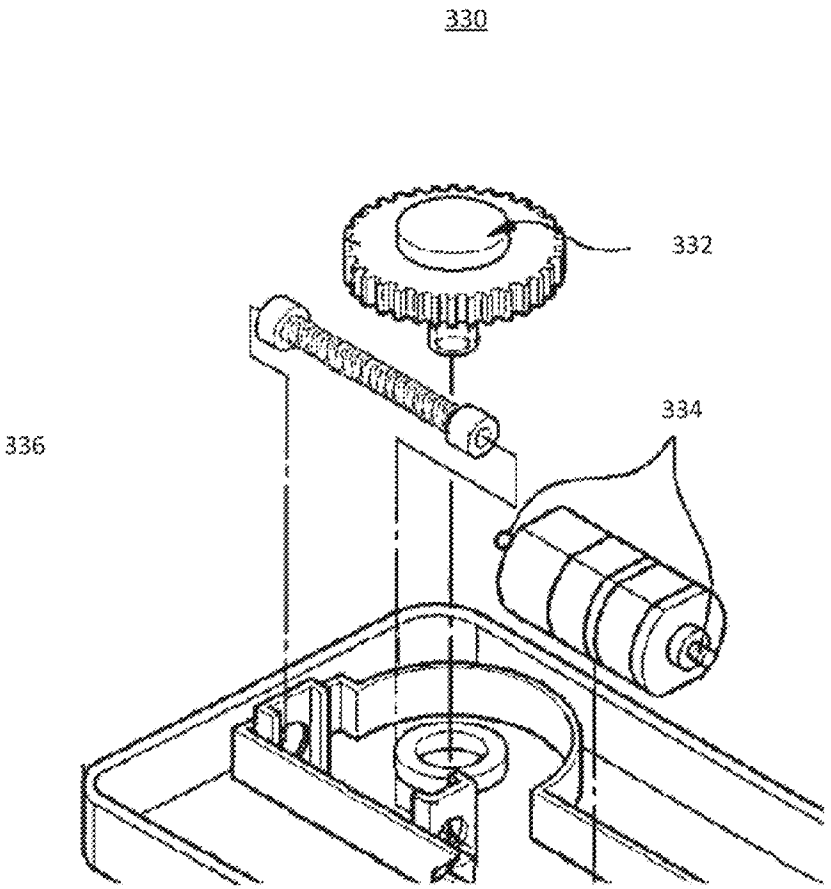
FIG. 3B illustrates an exemplary exploded view of a rotating mechanism for the set of brushes of FIG. 3A, in accordance with various embodiments of the present disclosure.

FIGS. 3A-3B depict example perspective views of portions of at least one bottom brush 310 in accordance with various embodiment of the present disclosure. In various embodiments, as depicted in FIG. 3A, the one or more bottom brushes 310 may comprise of a plurality of bristles 320. The plurality of bristles 320 may be configured to contact the bottom surface 1000 of a cleaning environment (e.g., tub and/or shower). The plurality of bristles 320 may be further configured to flex and/or bend during oscillations and/or rotation of the corresponding bottom brush. In various embodiments, the plurality of bristles 320 may be further configured to receive water and/or cleaning solution from the water reservoir and/or from the cleaning solution reservoir to assist in the cleaning of the bottom surface 1000 of the tub and/or shower. In one or more embodiments, the plurality of bristles 320 may be configured to be at least a portion of the first bottom brush 310A and/or the second bottom brush 310B.

With reference to FIG. 3A, in various embodiments, a plurality of bristles 320 may be configured to contact the bottom surface 1000 of the cleaning environment (e.g., tub and/or shower). In various embodiments, the plurality of bristles 320 may be flexible and/or are configured to bend at least in part upon rotation. In various embodiments, the plurality of bristles 320 may be configured to receive cleaning solution and/or water from the corresponding reservoirs, wherein the plurality of bristles 320 may be configured deliver the cleaning solution and/or water to the bottom surface 1000 of the bathtub and/or shower.

With reference to FIG. 3B, a rotating and oscillating mechanism 330 is depicted in accordance with various embodiments of the present disclosure. In various embodiments, the rotating and oscillating mechanism 330 may comprise at least one gear 332, at least one motor 334, and/or at least one worm gear 336. The at least one motor 334 may be configured to engage with the at least one worm gear 336, wherein the motor 334 may be configured to cause the worm gear 336 to rotate. In various embodiments, the worm gear 336 may be further configured to engage with the at least one gear 332. The gear 332 may be configured to engage with and/or assist in rotating and/or oscillating one or more bottom brushes 310. The motor 334 of the rotating and oscillating mechanism 330 may be configured to activate simultaneously and/or separately from the activation of a cycle of the robotic device 10.

Figure 3C:
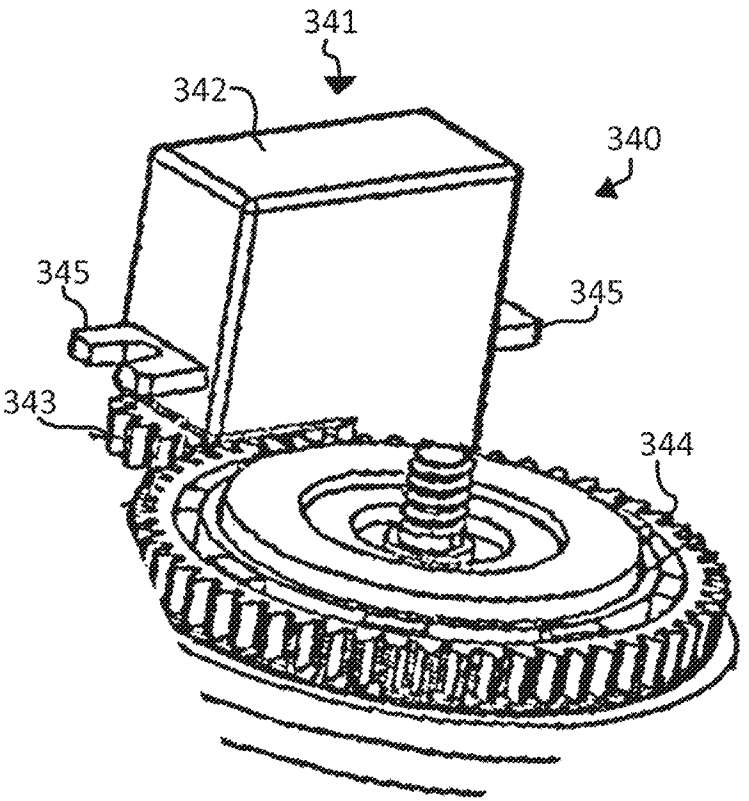
FIG. 3C illustrates an exemplary isometric view of a sidewall drive mechanism of a robotic device, in accordance with various embodiments of the present disclosure.

With reference to FIG. 3C, a sidewall drive mechanism 340 is depicted, in accordance with an example embodiment, which may oscillate the sidewall brushes 204 along the opening 203 of the robotic device 10. The sidewall drive mechanism 340 may include an assembly 341. The assembly 341 may include a housing 342, a motor 209 (FIG. 3F) positioned within the housing 342, and a small gear 343 that is coupled to the motor 209. The small gear 343 may comprise a plurality of gear teeth. At least one of the sidewall brushes 204 may be coupled, directly or indirectly (e.g., through connection rods 202), to an attachment feature 345 that extends from the housing 342. The motor 209 within the housing 342 may be configured to rotate the small gear 343. The assembly 341 may be positioned such that the gear teeth of the small gear 343 mesh with gear teeth of a large gear 344. The large gear 344 may be positioned such that a vertical center of the large gear 344 generally aligns with a vertical center of the body portion 102 of the robotic device 10. The large gear 344 may be stationary relative to the body portion 102 of the robotic device 10. The large gear 344 may be positioned upward from the rotating and oscillating mechanism 330. When the small gear 343 is rotated by the motor 209 within the housing 342, the assembly 341 may rotate circumferentially around the large gear 344. The sidewall drive mechanism 340 may oscillate the sidewall brushes 204 from the respective first linear position at the first end of the robotic device 10 to the second linear position at the second position of the robotic device 10. The sidewall drive mechanism 340 may further cause the sidewall brushes 204 to simultaneously rotate while oscillating along the opening of the robotic device 10.

Figure 3D:
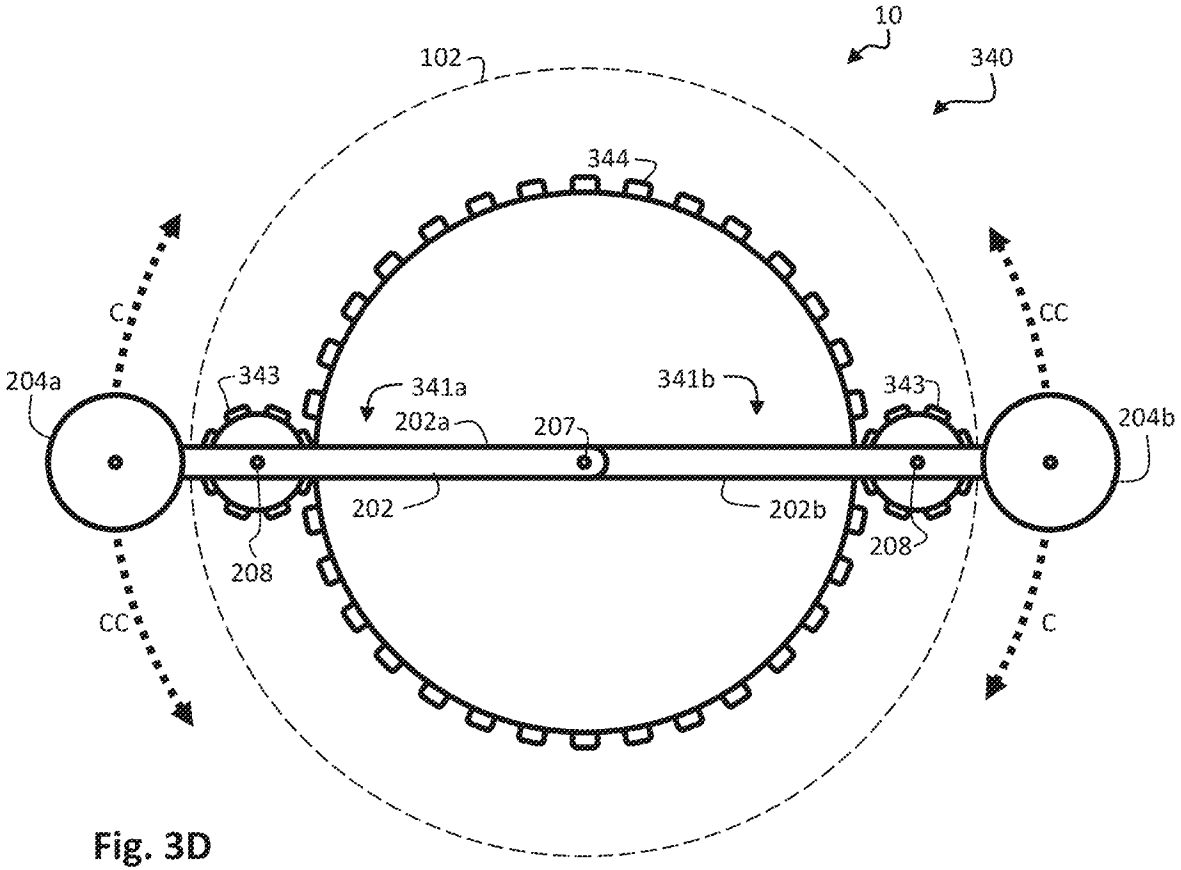
FIG. 3D illustrates a schematic, top view of a robotic device, in accordance with various embodiments of the present disclosure.
Figure 3E:
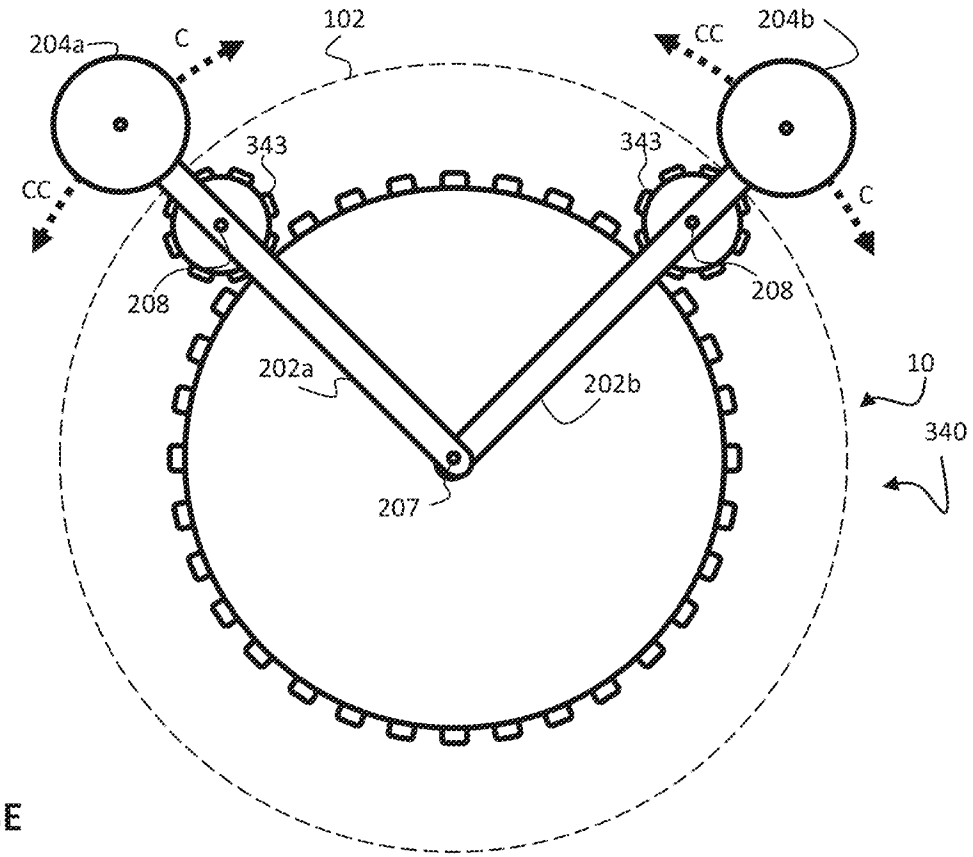
FIG. 3E illustrates a schematic, top view of a robotic device, in accordance with various embodiments of the present disclosure.
Figure 3F:
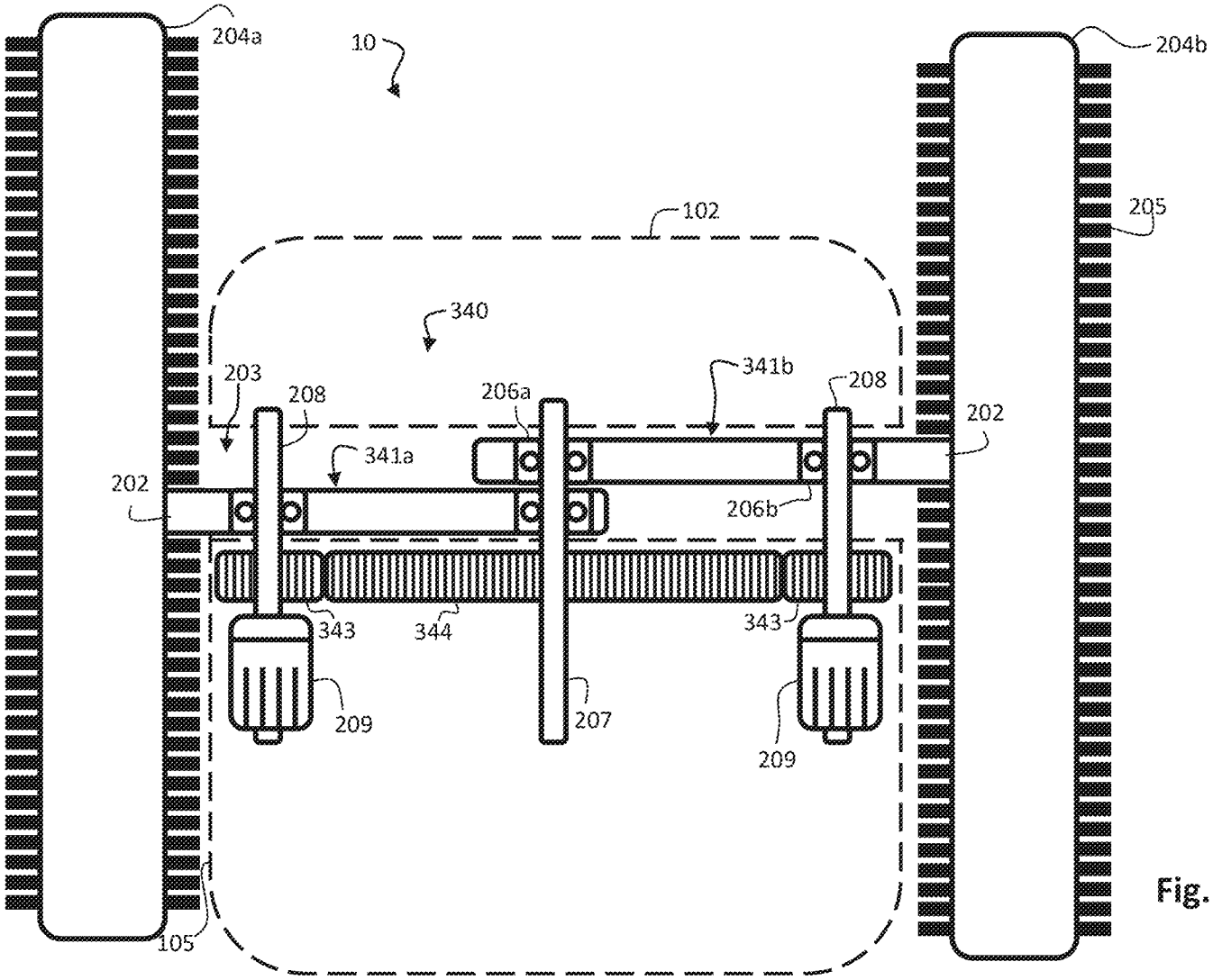
FIG. 3F illustrates a schematic, side view of a robotic device, in accordance with various embodiments of the present disclosure.

Referring to FIGS. 3D-3F, schematic views of a robotic device 10 that includes a sidewall drive mechanism 340 is depicted, in accordance with an example embodiment. FIGS. 3D and 3E depict cross-sectional, top views of the robotic device 10 and FIG. 3F depicts a cross-sectional, side view of the robotic device 10. As discussed, the sidewall drive mechanism 340 may oscillate the sidewall brushes 204 along the opening 203 of the robotic device 10. The sidewall drive mechanism 340 may include a large gear 344 and at least one assembly 341, such as a first assembly 341*a*, that orbits around the large gear 344 (e.g., rotates circumferentially around the large gear 344). The first assembly 341*a* may be coupled to a first sidewall brush 204*a*. The sidewall drive mechanism 340 may include a second assembly 341*b* that may be configured similarly or the same as the first assembly, and may be coupled to a second sidewall brush 204*b*.

Each assembly 341 may include a connection rod 202. Each connection rod 202 may be pivotably coupled to a vertical center shaft 207 that may be positioned in a center of the robotic device 10. For example, each connection rod 202 may include at least one bearing 206*a* (FIG. 3F) that allows the connection rod 202 to pivot around the center shaft 207. The center shaft 207 may extend through a center of the large gear 344. The center shaft 207 and the large gear 344 may be configured to remain stationary relative to a body portion 102 of the robotic device 10.

Each assembly 341 may include a vertical distal shaft 208, which may be pivotably connected to the respective connection rod 202. For example, each connection rod 202 may include at least one bearing 206*b* that allows the vertical distal shaft 208 to pivot relative to the connection rod 202. Each vertical distal shaft 208 may be coupled to a motor 209, which may be an electric motor. The motor 209 may be configured to rotate the distal shaft 208. Each distal shaft 208 may be rigidly coupled to a small gear 343. As such, rotation of the distal shaft 208 by the motor 209 may cause rotation of the small gear 343.

Rotation of the small gear 343 may cause the small gear 343 to orbit around the large gear 344 (e.g., rotate circumferentially around the large gear 344). The circumferential movement of the small gear 343 may cause the vertical distal shaft 208, the motor 209, the connection rod 202, and the sidewall brush 204 to pivot around an axis defined by the center shaft 207. Stated differently, rotation of the small gear 343 may cause the respective sidewall brush 204 to oscillate along the opening 203 of the robotic device 10. For example, rotation of the small gear 343 in a clockwise direction by the motor may cause the respective sidewall brush 204 to orbit around the body portion 102 of the robotic device 10 in a clockwise direction, as denoted by arrow C in FIGS. 3D and 3E. Similarly, rotation of the small gear 343 in a counterclockwise direction by the motor may cause the respective sidewall brush 204 to orbit around the body portion 102 of the robotic device 10 in a counterclockwise direction, as denoted by arrow CC in FIGS. 3D and 3E.

As will be appreciated, each sidewall brush 204 may be controlled independently. As such, a first sidewall brush 204*a* may move clockwise while a second sidewall brush 204*b* moves counterclockwise. In various examples, a first sidewall brush 204*a* may move clockwise while a second sidewall brush 204*b* also moves clockwise. Each sidewall brush 204 may completely orbit around the body portion, such that it rotates more than 360 degrees around the body portion 102 of the robotic device 10.

Figure 3G:
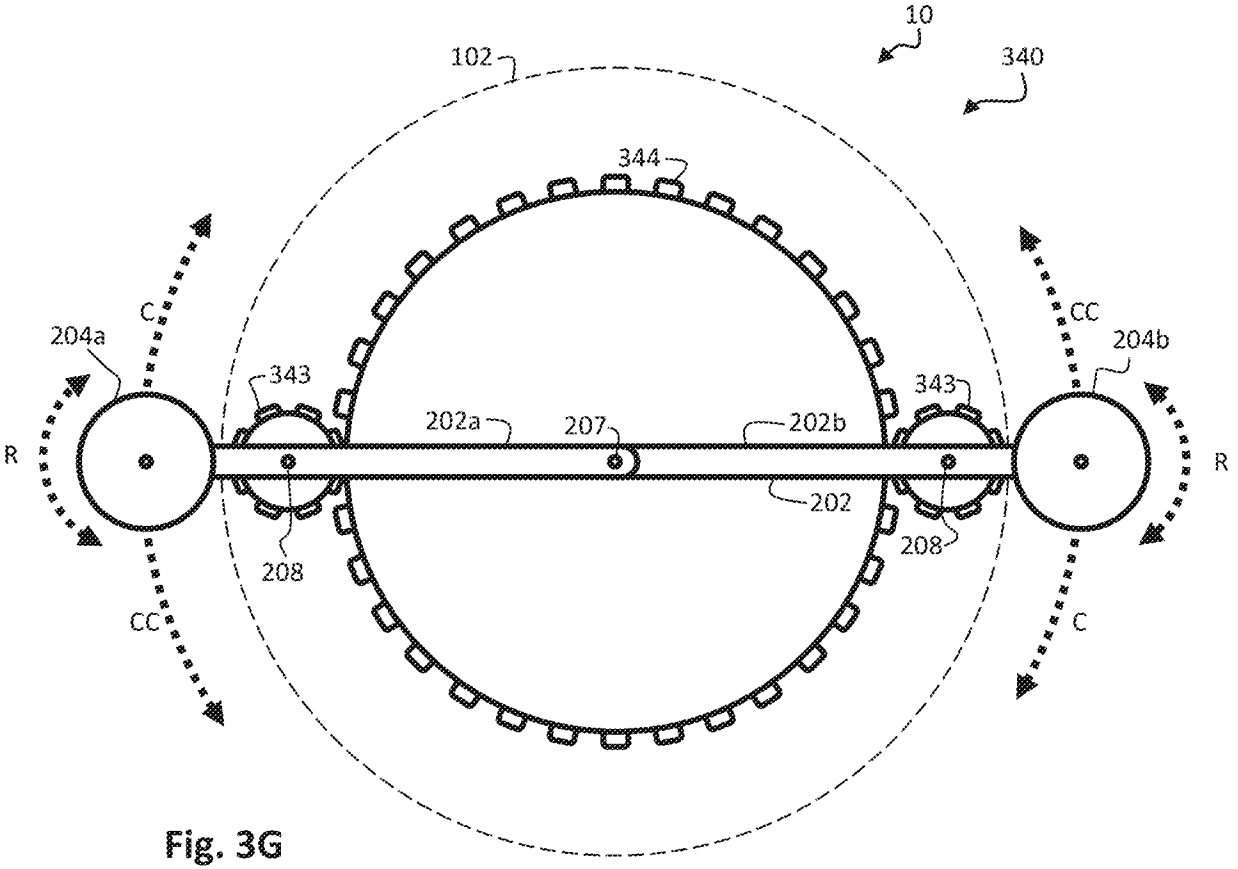
FIG. 3G illustrates a schematic, top view of a robotic device, in accordance with various embodiments of the present disclosure.
Figure 3H:
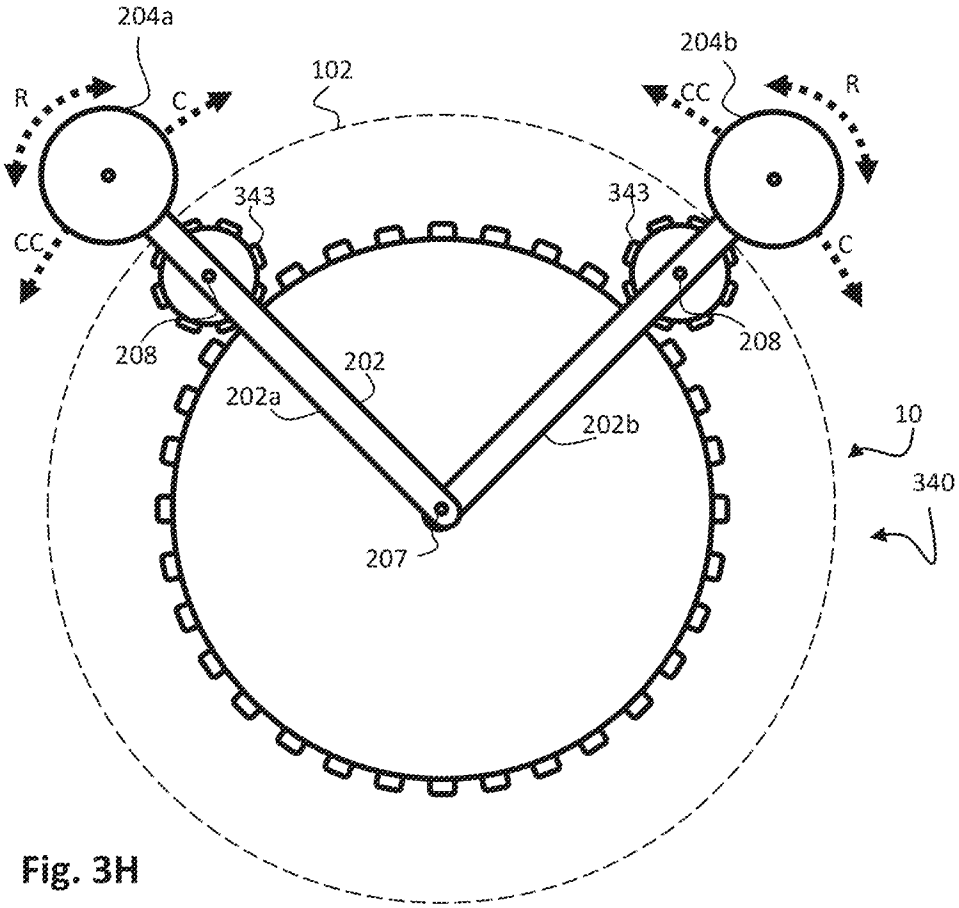
FIG. 3H illustrates a schematic, top view of a robotic device, in accordance with various embodiments of the present disclosure.
Figure 3I:
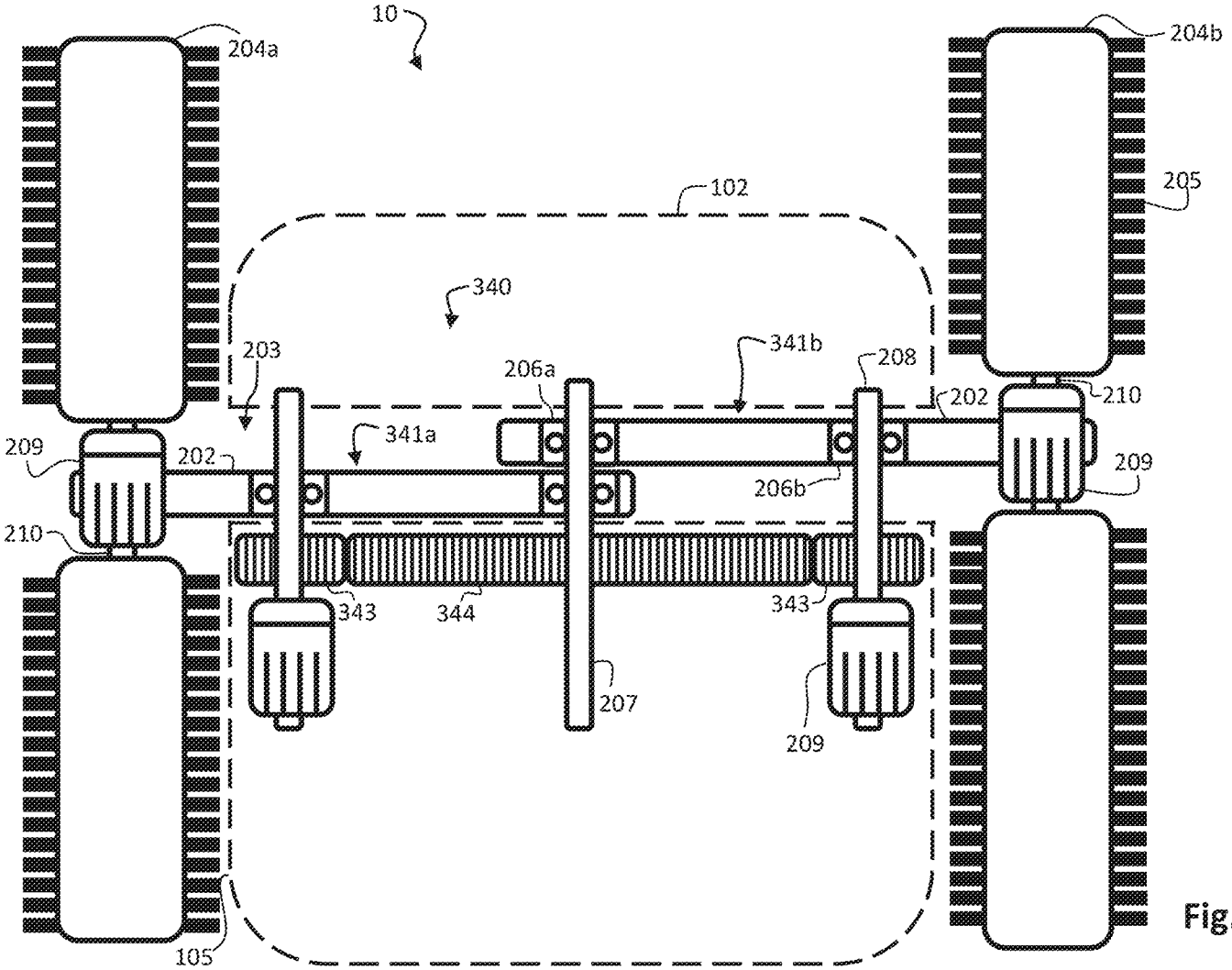
FIG. 3I illustrates a schematic, side view of a robotic device, in accordance with various embodiments of the present disclosure.

Referring to FIGS. 3G-3I, schematic views of a robotic device 10 that includes a sidewall drive mechanism 340 is depicted, in accordance with an example embodiment. FIGS. 3G and 3H depict cross-sectional, top views of the robotic device 10 and FIG. 3I depicts a cross-sectional, side view of the robotic device 10. The robotic device 10 of FIGS. 3G-3I may be configured similarly to the robotic device 10 FIG. 3D-DF. However, the robotic device 10 of FIGS. 3G-3I may include at least one motor 209 that is configured to rotate at least one sidewall brush 204 on an axis that extends through the at least one sidewall brush 204. For example, a motor 209 may be coupled to a distal end of each connection rod 202, which may be configured to rotate a sidewall brush shaft 210 that is coupled to, or integral with, a sidewall brush 204.

In various examples, rotation of the motor at the distal end of the connection rod 202 may cause the respective sidewall brush 204 to rotate, as denoted by arrow R in FIGS. 3G and 3H. As such, each sidewall brush 204 may rotate on its own axis, as denoted by arrow R, and may also orbit around a body portion 102 of the robotic device 10, as denoted by arrows C and CC.

Figure 5:
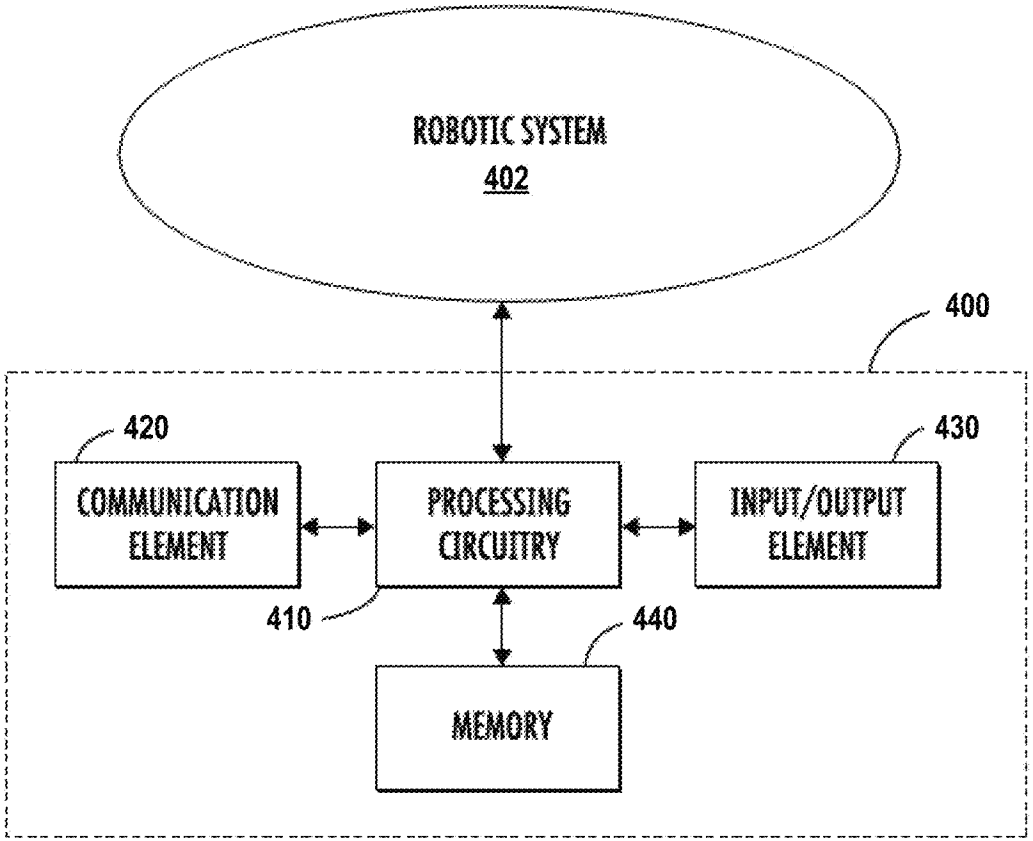
FIG. 5 illustrates an exemplary schematic of a controller in accordance with various embodiments of the present disclosure.

FIG. 5 is a schematic representation of example components in an example controller in accordance with various aspects of the present disclosure.

FIG. 5 shows a schematic block diagram of an example circuitry, some or all of which may be included in controller 400. In accordance with some example embodiments, circuitry may include various means, such as processor 410, communication element 420, input/output element 430, and/or memory 440. In some embodiments, such as when circuitry is included in controller 400. Although these components (e.g., processor 410, memory 440, etc.) are described with respect to functional limitations, it should be understood that the particular implementations necessarily include the use of particular hardware, software, and/or firmware. It should also be understood that certain of these components (e.g., processor 410, memory 440, etc.) may include similar or common hardware. For example, multiple sets of circuitry may both leverage use of the same processor, network interface, storage medium, or the like to perform their associated functions, such that duplicate hardware is not required for each set of circuitry.

The term "circuitry" should also be understood, in some embodiments, to include software for configuring the hardware. For example, in some embodiments, "circuitry" may include processing circuitry, storage media, network interfaces, input/output devices, and the like. In some embodiments, such as in examples where circuitry is included with controller 400 may provide or supplement the functionality of particular circuitry. For example, the processor 410 may provide processing functionality, the memory 440 may provide storage functionality, the communications element 420 may provide network interface functionality, and the like.

In some embodiments, the controller component 400 can be or comprise a printed circuited board (PCB). In some examples, the controller component 400 (e.g., PCB) can further comprise one or more of a full bridge motor driver, a sensor, one or more thermal sensors, one or more user interfaces, one or more protection circuits, configuration management circuitry, a wireless interface, sensing element circuitry (e.g., image sensor circuitry), an interface connector, power control circuitry, gate driver circuitry and/or the like.

The processing circuitry 410 can be embodied as means including one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, but not limited to, an application specific integrated circuit (ASIC) or field programmable gate array (FPGA), or some combination thereof. Accordingly, although illustrated in FIG. 5 as a single processor, in an embodiment, the processing circuitry 410 can include a plurality of processors and signal processing modules. The plurality of processors can be embodied on a single electronic device or can be distributed across a plurality of electronic devices collectively configured to function as the circuitry of the robotic system 402. The plurality of processors can be in operative communication with each other and can be collectively configured to perform one or more functionalities of the circuitry of the robotic system as described herein. In an example embodiment, the processing circuitry 410 can be configured to execute instructions stored in the memory 440 or otherwise accessible to the processing circuitry 410. These instructions, when executed by the processing circuitry 410, can cause the circuitry of the robotic system 402 to perform one or more of the functionalities, as described herein.

In various embodiments, the controller 400 may be configured to communicate with a robotic system 402 via wireless external communication networks using any of a variety of protocols, such as embedded sim (eSIM), remote sim provisioning (RSP), general packet radio service (GPRS), Universal Mobile Telecommunications System (UMTS), Code Division Multiple Access 200 (CDMA200), CDMA200 1× (1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), Wi-Fi Direct, 802.16 (WiMAX), ultra-wideband (UWB), IR protocols, NFC protocols, RFID protocols, IR protocols, ZigBee protocols, Z-Wave protocols, 6LoWPAN protocols, Wibree, Bluetooth protocols, wireless universal serial bus (USB) protocols, and/or any other wireless protocol.

In one or more embodiments, the controller 400 may be configured to communicate via one or more communication elements 420, wherein the controller 400 may be configured to transmit operation instructions to one or more components of the robotic systems. In various embodiments, the controller 400 may be configured to communicate with the robotic system 402, wherein the controller may be configured to communicate with one or more sensors of the robotic system 402 configured to detect the location of the robotic system within the surrounding environment.

Whether configured by hardware, firmware/software methods, or by a combination thereof, the processing circuitry 410 can include an entity capable of performing operations according to embodiments of the present disclosure while configured accordingly. Thus, for example, when the processing circuitry 410 is embodied as an ASIC, FPGA or the like, the processing circuitry 410 can include specifically configured hardware for conducting one or more operations described herein. Additionally, or alternatively, when the processing circuitry 410 is embodied as an executor of instructions, such as can be stored in the memory 440, the instructions can specifically configure the processing circuitry 410 to perform one or more algorithms and operations described herein.

Thus, the processing circuitry 410 used herein can refer to a programmable microprocessor, microcomputer or multiple processor chip or chips that can be configured by software instructions (applications) to perform a variety of functions, including the functions of the various embodiments described above. In some devices, multiple processors can be provided dedicated to wireless communication functions and one processor dedicated to running other applications. Software applications can be stored in the internal memory before they are accessed and loaded into the processors. The processors can include internal memory sufficient to store the application software instructions. In many devices, the internal memory can be a volatile or nonvolatile memory, such as flash memory, or a combination thereof. The memory can also be located internal to another computing resource (e.g., enabling computer readable instructions to be downloaded over the Internet or another wired or wireless connection.

The memory 440 can include suitable logic, circuitry, and/or interfaces that are adapted to store a set of instructions that is executable by the processing circuitry 410 to perform predetermined operations. Additionally, or alternately, the memory 440 can be configured to store data/information, application programs, instructions, etc., so that the controller component 400 can execute various functions according to the embodiments of the present disclosure. For example, in at least some embodiments, the memory 440 is configured to cache input data for processing by the processing circuitry 410. Thus, in at least some embodiments, the memory 440 is configured to store program instructions for execution by the processing circuitry 410. The memory 440 can store information in the form of static and/or dynamic information. When the functions are executed, the stored information can be stored and/or used by the controller component 400. Example memory embodiments can include, but are not limited to, a hard disk, random access memory, cache memory, read only memory (ROM), erasable programmable read-only memory (EPROM) & electrically erasable programmable read-only memory (EEPROM), flash memory, magnetic cassettes, magnetic tape, magnetic disk storage or other magnetic storage devices, a compact disc read only memory (CD-ROM), digital versatile disc read only memory (DVD-ROM), an optical disc, circuitry configured to store information, or some combination thereof. In an example embodiment, the memory 440 can be integrated with the processing circuitry 410 on a single chip, without departing from the scope of the disclosure.

The communication element 420 can be implemented as any apparatus included in a circuit, hardware, a computer program product, or a combination thereof, which is configured to receive and/or transmit data from/to another component or apparatus. The computer program product comprises computer-readable program instructions stored on a computer-readable medium (for example, the memory 440) and executed by a processor 410 (for example, the processing circuitry 410). In some embodiments, the communication element 420 (as with other components discussed herein) can be at least partially implemented as the processing circuitry 410 or otherwise controlled by the processing circuitry 410. In this regard, the communication element 420 can communicate with the processing circuitry 410, for example, through a bus. The communication element 420 can comprise, for example, antennas, transmitters, receivers, transceivers, network interface cards and/or supporting hardware and/or firmware/software and is used for establishing communication with another apparatus. The communication element 420 can be configured to receive and/or transmit any data that can be stored by the memory 440 by using any protocol that can be used for communication between apparatuses. The communication element 420 can additionally or alternatively communicate with the memory 440, the input/output element 430 and/or any other component of the processor 410, for example, through a bus.

In some embodiments, the controller 400 can comprise an input/output element 430. The input/output element 430 can communicate with the processing circuitry 410 to receive instructions input by the user and/or to provide audible, visual, mechanical, or other outputs to the user. Therefore, the input/output element 430 can comprise supporting devices, such as a keyboard, a mouse, a display, a touch screen display, microphone, audio recorder, speaker, biometric scanner, and/or other input/output mechanisms. In various embodiments, the robotic system 402 may be activated by a voice command, wherein the input/output element 430 receives the instructions and communicates the instructions to the processing circuitry 410. Alternatively, at least some aspects of the input/output element 430 can be implemented on a device used by the user to communicate with the controller 400. The input/output element 430 can communicate with the memory 440, the communication element 420 and/or any other component, for example, through a bus. One or a plurality of input/output modules and/or other components can be included in the controller 400.

In various embodiments, the input/output element 430 may communicate with one or more electronic devices (e.g., user phone, tablet, computer, etc.) to receive one or more instructions and/or commands. The instructions and/or command may determine the cycle type and/or run time of the robotic system. The input/output element 430 may further relay messages (e.g., status updates, etc.) from the controller 400 to the electronic devices. In various embodiments, the controller may be executed the received instructions and/or commands via the processing circuitry 410 and/or memory 440. The processing circuitry 410 and/or memory 440 may cause the robotic device 10 to complete at least one cycle and/or operate for a predetermined amount of time.

As described above and as will be appreciated based on this disclosure, embodiments of the present disclosure may be configured as systems, methods, apparatuses, computing devices, personal computers, servers, mobile devices, back-end network devices, and the like. Accordingly, embodiments may comprise various means including entirely of hardware or any combination of software and hardware. Furthermore, embodiments may take the form of a computer program product on at least one non-transitory computer-readable storage medium having computer-readable program instructions embodied in the computer-readable storage medium (e.g., computer software stored on a hardware device). Any suitable computer-readable storage medium may be utilized including non-transitory hard disks, CD-ROMs, flash memory, optical storage devices, or magnetic storage devices.

As will be appreciated, any such computer program instructions and/or other type of code may be loaded onto a computer, processor or other programmable apparatus's circuitry to produce a machine, such that the computer, processor, or other programmable circuitry that execute the code on the machine creates the means for implementing various functions, including those described herein in connection with the components of circuitry.

In various embodiments, the controller 400 may be configured to control the location of the robotic device 10, control the cycle type of the robotic device 10, control the cycle time of the robotic device 10, control the location of the robotic device 10, etc. In various embodiments, the controller 400 may be further configured to collect location data regarding the location of the robotic device 10, collect path data of the robotic device 10, cleaning data of the robotic device 10, and/or the like.

Figure 6:
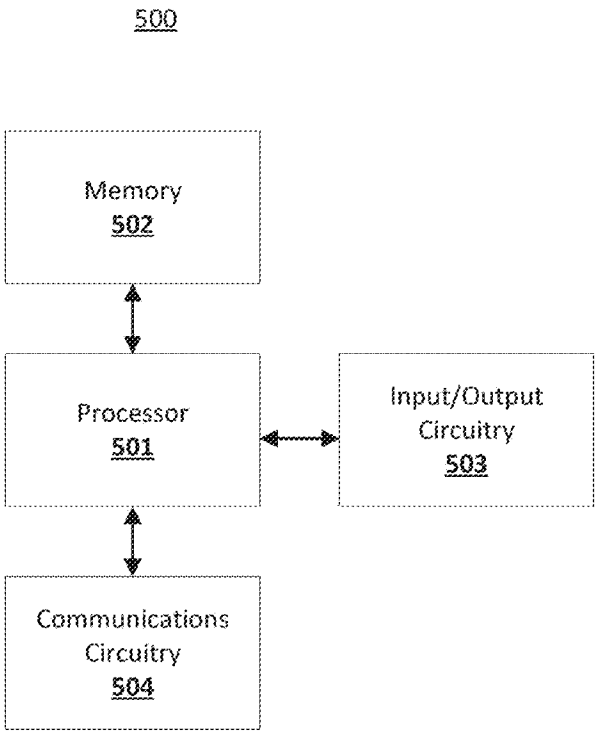
FIG. 6 illustrates an exemplary schematic of a mobile device for use with various embodiments of the present disclosure.

FIG. 6 shows a schematic block diagram of an exemplary circuitry. Some or all of which may be included in a user device 500, in accordance with some example embodiments circuitry may include various means such as processor 501, memory 502, input/output circuitry 503, and/or communications circuitry 504.

In some embodiments, the processor 501 (and/or coprocessor or any other processing circuitry assisting or otherwise associated with the processor) may be in communication with the memory 502 via a bus for passing information among components of, for example, a user device 500. The memory 502 is non transitory and may include, for example, one or more volatile and/or non-volatile memories or some combination thereof. In other words, for example, the memory 502, may be a storage device (e.g., a computer readable storage medium). The memory 502 may be configured to store information, data, content application instruction and/or the like for enabling an apparatus (e.g., user device 500) to carry out various functions in accordance with example embodiments of the present disclosure. Although illustrated in FIG. 6 as a single memory, memory 502 may comprise a plurality of memory components. The plurality of memory components may be embodied on a single computing device or distributed across a plurality of user devices. In various embodiments, memory 502 may comprise, for example, a hard disk, random access memory, cache memory, flash memory, a compact disk, read only memory (CD-ROM), digital versatile disk read only memory (DVD-ROM), an optical disk, circuitry configured to store information, or some combination thereof.

Memory 502 may be configured to store information, data, application instructions and/or the like for enabling circuitry to carry out various function in accordance with example embodiments discussed herein. In an example embodiment, processor 501 is configured to execute instructions stored in the memory 502 or otherwise accessible to the processor 501. Alternatively or additionally, the processor 501 may be configured to execute hard coded functionalities. As such, whether configured by hardware or software methods or by a combination thereof, the processor 501, may represent an entity (e.g., physically embodied in circuitry) capable of performing operations according to an embodiment of the present disclosure. Alternatively, as in another example, when the processor 501 is embodied as an executor of software instructions, the instructions may specifically configure processor 501 to perform one or more algorithms and/or operations described herein when the instructions are executed. For example, these instructions when executed by processor 501 may cause user device 500 to perform one or more functionalities of a user device as described herein. In some embodiments, input/output circuitry 503 may in turn be in communication with processor 501 to provide an audible, visual, mechanical or other output and/or in some embodiments to receive an indication of input.

Input/output circuitry 503 may include means for performing analog to digital and/or digital to analog data conversion. Input/output circuitry 503 may include support, for example, for a display, touch screen, keyboard, button, click wheel, mouse, joystick, an image capturing device (e.g., a camera), motion sensor (e.g., accelerometer and/or gyroscope), microphone, audio recorder, speaker, biometric scanner and/or other input/output mechanisms. Input/output circuitry 503 may comprise a user interface (e.g., a teamwork user interface, an interactive team assessment interface, a team health metrics dashboard, etc.) and may comprise a web-user interface, a mobile application, a kiosk and/or the like. The processor 501 and/or other interface circuitry comprising the processor 501 may be configured to control one or more functions of a display or one or more user interface elements through computer program instruction (e.g., software and/or firmware) stored on a memory accessible to the processor 501 (e.g., memory 502, and/or the like).

In various embodiments, a user may use the input/output circuitry 503 to send one or more instructions and/or commands to the robotic system. The instructions and/or commands may comprise information regarding the selection of a cycle type and/or a run time for the robotic system. In various embodiments, the input/output circuitry 503 may be further configured to power on and/or off the robotic system.

Communications circuitry 504 may be any means such as a device or circuitry embodied in either hardware or a combination of hardware and software that is configured to receive and/or transmit data from/to a network and/or any other device, circuitry or module in communication with circuitry (e.g., user device 500). In this regard, the communications circuitry 504 may include, for example, a network interface for enabling communication with a wired or wireless communication network. Communications circuitry 504 may be configured to receive and/or transmit any data that may be stored by memory 502 using protocols that may be used for communication between computing devices. For example, the communications circuitry 504 may include one or more network interface cards, antenna, transmitter, receiver, buses, switches, routers, modems and supporting hardware and/or software, and/or firmware/software, or any other device suitable for enabling communications via network. Additionally or alternatively, the communication interface may include the circuitry for interacting with the antenna to cause transmission of signal via the antenna or to handle receipt of signals received via the antenna. These signals may be transmitted by circuitry using any of a number of wireless, personal area networks (PAN) technology, such as Bluetooth V 1.0 though V 3.0, Bluetooth low energy (BLE), inferred wireless (e.g., IRDA), ultra-wide band (UWB), induction wireless transmission, and/or the like. In addition, it should be understood that these signals may be transmitted using Wi-Fi, Near Field communications (NFC), world-wide interoperability for microwave access (WiMAX), and/or other proximity-based communications protocols. Communications circuitry 504 may additionally or alternatively be in communication with the memory 502, input/output circuitry 503 and or any other component of the circuitry via a bus.

Figure 7:
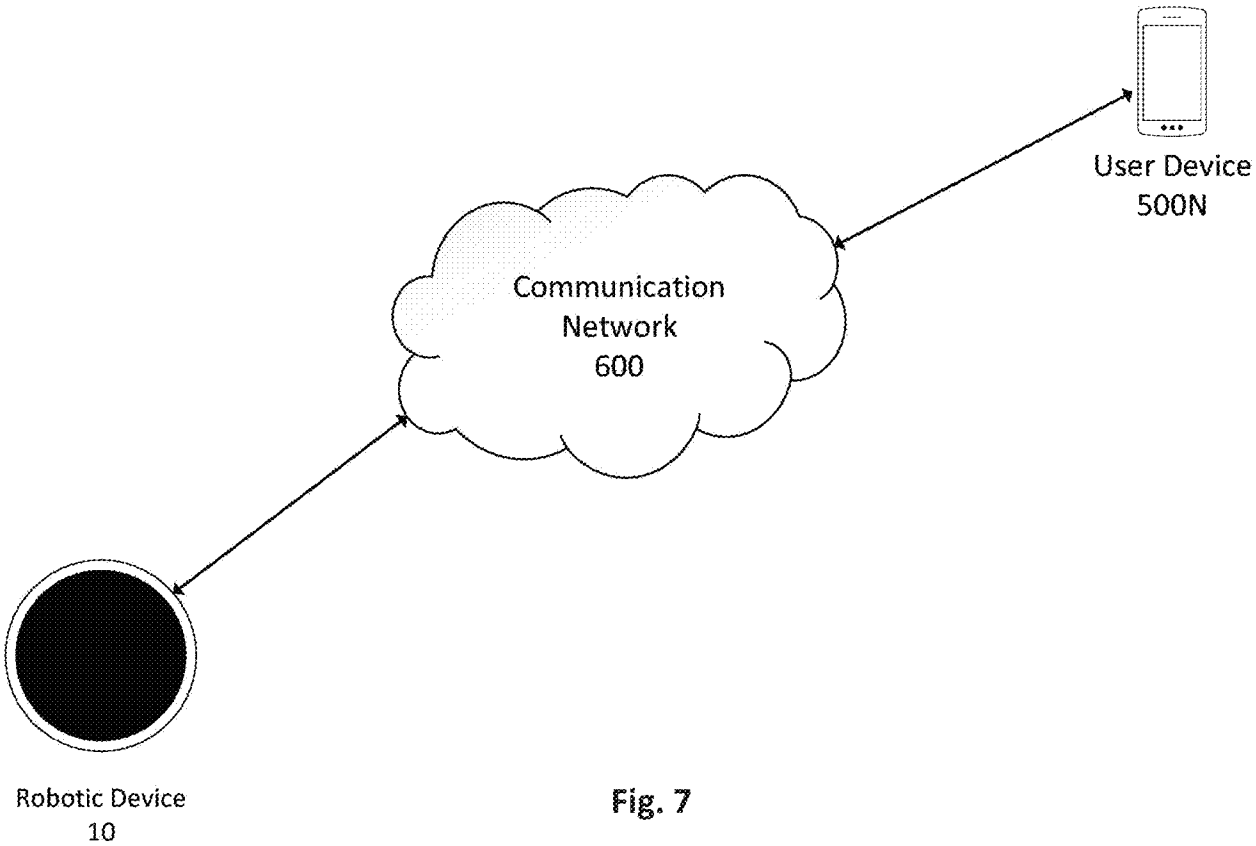
FIG. 7 illustrates an exemplary schematic of a communication network in accordance with various embodiments of the present disclosure.

FIG. 7 depicts an exemplary communications network allowing for communication between a robotic device 10 and one or more user devices.

Robotic device 10 can communicate with one or more user devices 500 via a communication network 600. Communication network 600 may include any one or more wired and/or wireless communication networks including, for example, a wired or wireless local area network (LAN), personal area network (PAN), metropolitan area network (MAN), wide area network (WAN), or the like, as well as any hardware, software, and/or firmware requires for implementing the one or more networks (e.g., network routers, switches, hubs, etc.). For example, communications network 600 may include a cellular telephone, mobile broadband, long term evolution (LTE), GSM/EDGE, UMTS/HSPA, IEEE 802.11, IEEE 802.16, IEEE 802.20, Wi-Fi, dial-up, Bluetooth, and/or WiMAX network. Furthermore, the communications network 600 may include a public network, such as the Internet, a private network, such as an intranet, or combination thereof, and may utilize a variety of networking protocols now available or later developed including, but not limited to TCP/IP based networking protocols. For instance, the networking protocol may be customized to suit the needs of the robotic device 10.

With further reference to FIG. 7, in various embodiments, one or more user devices 500 may be configured to transmit instructions to the robotic device 10 via the communication network 600. The one or more user devices 500 may be configured to transmit instruction via Wi-Fi, Bluetooth, etc. to the robotic system. In various embodiments, the one or more instruction may comprise a cleaning cycle, mapping a cleaning surface, and/or the like. The communication element 420 may be configured to connect to the communication network 600 and/or receive the instructions from the user device 500. In other embodiments, at least one user device 500 may be configured to connect directly to the robotic device 10.

Figure 8:
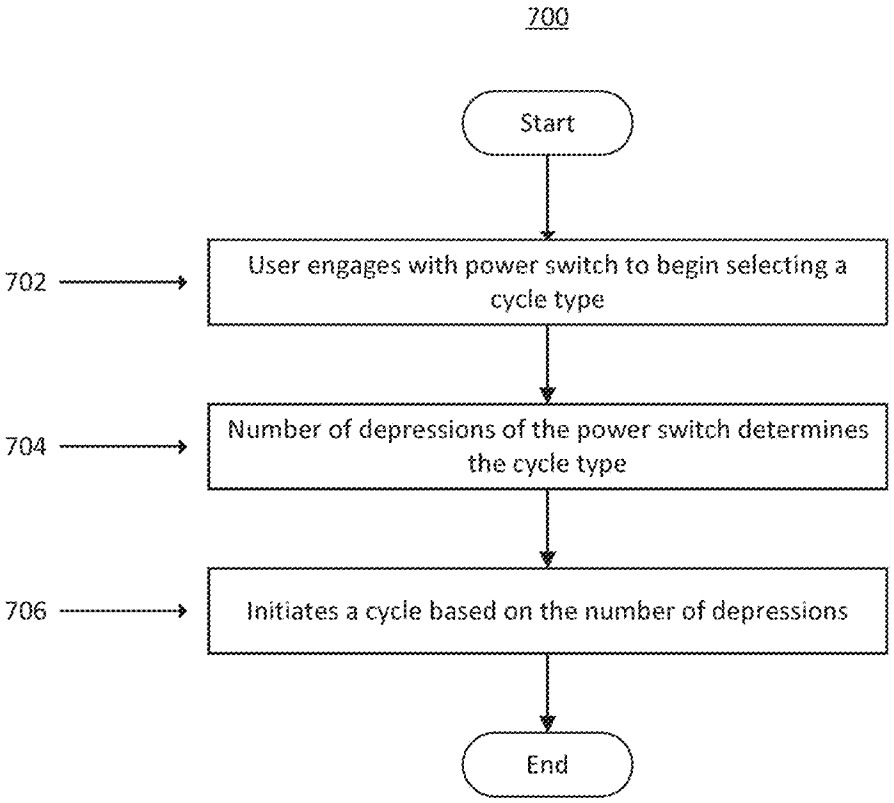
FIG. 8 illustrates an exemplary flowchart of a method to begin a cycle in accordance with various embodiments of the present disclosure.

With reference to FIG. 8, a flowchart of a method 700 to begin a cycle is depicted, in accordance with an example embodiment. The method 700 may include a step 702 of a user engaging with a power switch to begin selecting a cycle type. The method 700 may include a step 704 of determining the cycle type depending on the number of depressions of the power switch. The method 700 may include a step 706 of initiating a cycle based on the number of depression.

Many modifications and other embodiments of the present disclosure set forth herein will come to mind to one skilled in the art to which these embodiments pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A robotic device for cleaning a surrounding environment, the robotic device comprising:

a body portion that defines at least a top surface, a bottom surface, and a continuous sidewall surface, wherein the sidewall surface is defined by a perimeter of the body portion;

a large gear positioned within the body portion;

a drive system that includes at least two drive elements configured to propel the robotic device within the surrounding environment, wherein the at least two drive elements extend a distance beneath the bottom surface;

two or more bottom brushes having a primary axis of each brush that extends below the bottom surface and extend at least partially beyond the at least two drive elements to engage the surrounding environment;

the continuous opening that extends around the sidewall surface, wherein the continuous opening is defined along the sidewall surface between the top surface and the bottom surface, and wherein the continuous opening extends purely horizontally around an entirety of the perimeter of the body portion;

at least one sidewall brush that extends from the body portion and is configured to travel along the continuous opening and relative to the top surface and the bottom surface of the body portion; and at least one sidewall drive mechanism, wherein:

each sidewall drive mechanism comprises:

a connection rod a motor; and a small gear that is coupled to the motor and is configured to be rotatable by the motor, wherein the small gear is positioned such that gear teeth of the small gear mesh with gear teeth of the large gear, and each of the at least one sidewall brush is coupled to the respective connection rod of the respective sidewall drive mechanism, each sidewall drive mechanism is configured to orbit the respective sidewall brush around the body portion of the robotic device when the small gear is rotated by the motor.

2. The robotic device of claim 1, wherein the at least one sidewall brush is positioned in a vertical manner.

3. The robotic device of claim 2, wherein the at least one sidewall brush is configured to travel horizontally relative to the continuous opening of the robotic device.

4. The robotic device of claim 2, wherein a first sidewall brush of the at least one sidewall brush is configured to travel along a first side of the robotic device, and a second sidewall brush of the at least one sidewall brush is configured to travel along a second side of the robotic device, wherein the first side and the second side are relative to the sidewall surface.

5. The robotic device of claim 1, further comprising a bumper that extends around the body portion, wherein the bumper protects a finish of the surrounding environment.

6. The robotic device of claim 1, further comprising a controller and at least one sensor to detect a location of the robotic device in the surrounding environment and communicate the location to guide the robotic device.

7. The robotic device of claim 6, wherein the controller further comprises a processor configured to communicate with the controller of the robotic device.

8. The robotic device of claim 7, wherein the controller, directed by the processor, controls at least one traveling function of the at least one sidewall brush.

9. The robotic device of claim 1, wherein the continuous opening extends circumferentially around the sidewall surface and the at least one sidewall brush is configured to travel circumferentially along the continuous opening.

10. The robotic device of claim 1, wherein the at least one sidewall brush is positioned in a vertical manner, and wherein the at least one sidewall brush is configured to remain in the vertical position as it travels along the continuous opening.

11. The robotic device of claim 10, wherein the at least one sidewall brush extends vertically 18 inches tall.

12. The robotic device of claim 10, wherein the at least one sidewall brush extends vertically at least 6 inches and up to 18 inches tall.

13. The robotic device of claim 1, wherein each of the at least one sidewall brush comprises a plurality of bristles that are configured to contact a sidewall surface of a tub or shower when the robotic device is cleaning the surrounding environment.

14. The robotic device of claim 13, wherein the plurality of bristles are configured to receive a cleaning solution from a reservoir to deliver the cleaning solution to the sidewall surface of the tub or shower.

15. The robotic device of claim 1, wherein the robotic device is for cleaning a bottom surface and at least one sidewall of a bathtub or a shower.

16. The robotic device of claim 1, wherein the at least one sidewall brush is configured to move from a first position to a second position, wherein the first position is at a back of the robotic device and the second position is at a front of the robotic device.

17. The robotic device of claim 16, wherein the first position is at least ninety degrees from the second position relative to a center of the robotic device.

18. The robotic device of claim 1, wherein:

the continuous opening extends circumferentially around the sidewall surface and the at least one sidewall brush is configured to travel circumferentially along the continuous opening, the at least one sidewall brush is configured to move from a first position to a second position, wherein the first position is at a back of the robotic device and the second position is at a front of the robotic device, each of the at least one sidewall brush is positioned in a vertical manner, and wherein each of the at least one sidewall brush is configured to remain in the vertical position as it travels along the continuous opening from the first position to the second position, and each of the at least one sidewall brush extends vertically at least 6 inches and up to 18 inches tall.

19. The robotic device of claim 1, further comprising a vertical center shaft, wherein:

each connection rod is configured to pivot around the vertical center shaft.

20. The robotic device of claim 1, wherein each sidewall drive mechanism further comprises a second motor that is coupled to a distal end of the respective connection rod, wherein the second motor is configured to rotate the respective sidewall brush on an axis that extends through the sidewall brush.

* * * * *